US009886894B2

(12) United States Patent
Ohara et al.

(10) Patent No.: US 9,886,894 B2
(45) **Date of Patent: *Feb. 6, 2018**

(54) DISPLAY DEVICE AND METHOD FOR DRIVING SAME

(71) Applicant: Sharp Kabushiki Kaisha, Sakai, Osaka (JP)

(72) Inventors: Masanori Ohara, Sakai (JP); Noboru Noguchi, Sakai (JP); Noritaka Kishi, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/648,581

(22) Filed: Jul. 13, 2017

(65) Prior Publication Data

US 2017/0316735 A1 Nov. 2, 2017

Related U.S. Application Data

(62) Division of application No. 14/895,503, filed as application No. PCT/JP2014/069285 on Jul. 22, 2014, now Pat. No. 9,734,754.

(30) Foreign Application Priority Data

Sep. 10, 2013 (JP) ..... 2013-187218

(51) Int. Cl.
*G09G 5/00* (2006.01)
*G09G 3/30* (2006.01)
(Continued)

(52) U.S. Cl.
CPC ..... *G09G 3/30* (2013.01); *G09G 3/3233* (2013.01); *G09G 3/3266* (2013.01);
(Continued)

(58) Field of Classification Search
CPC ..... G09G 3/30; G09G 3/3233; G09G 3/3266; G09G 3/3291; G09G 2300/0809;
(Continued)

(56) References Cited

U.S. PATENT DOCUMENTS 9,495,894 B2 11/2016 Yamanaka et al.
9,734,754 B2 * 8/2017 Ohara ..... G09G 3/30
(Continued)

FOREIGN PATENT DOCUMENTS

JP 2004078124 A 3/2004
JP 2005284172 A 10/2005
(Continued)

OTHER PUBLICATIONS

International Search Report PCT/ISA/210 for International Application No. PCT/JP2014/069285 dated Oct. 21, 2014.
(Continued)

*Primary Examiner* — Vijay Shankar
(74) *Attorney, Agent, or Firm* — Harness, Dickey & Pierce, P.L.C.

(57) ABSTRACT

A drive circuit classifies frame periods as a drive period and a pause period, and applies a selection voltage to scanning lines in turn and applies voltages according to a video signal (a measurement voltage in the case of measurement targets) to data lines in turn during the drive period. During the pause period, the drive circuit applies the selection voltage to one scanning line corresponding to measurement target pixel circuits, and a measurement circuit measures drive currents outputted to the data lines from the measurement target pixel circuits. The drive circuit may set a write period and a measurement period in the pause period. During the write period, the drive circuit may apply the measurement voltage to the data lines. During the measurement period, the
(Continued)

measurement circuit may measure drive currents outputted to the data lines from the measurement target pixel circuits.

20 Claims, 13 Drawing Sheets

(51) Int. Cl.
*G09G 3/3266* (2016.01)
*G09G 3/3233* (2016.01)
*G09G 3/3291* (2016.01)

(52) U.S. Cl.
CPC ... *G09G 3/3291* (2013.01); *G09G 2300/0809* (2013.01); *G09G 2300/0842* (2013.01); *G09G 2310/0291* (2013.01); *G09G 2310/08* (2013.01); *G09G 2320/0233* (2013.01); *G09G 2320/0276* (2013.01); *G09G 2320/0285* (2013.01); *G09G 2320/0295* (2013.01); *G09G 2330/021* (2013.01)

(58) Field of Classification Search
CPC ... G09G 2300/0842; G09G 2310/0291; G09G 2310/08; G09G 2320/0295; G09G 2320/0233; G09G 2320/0276; G09G 2320/0285; G09G 2330/021
See application file for complete search history.

(56) References Cited

U.S. PATENT DOCUMENTS

| | | | |
|---|---|---|---|
| 2004/0036669 | A1 | 2/2004 | Yanagi et al. |
| 2007/0210996 | A1 | 9/2007 | Mizukoshi et al. |
| 2013/0314361 | A1 | 11/2013 | Saitoh et al. |
| 2015/0356899 | A1 | 12/2015 | Yamanaka et al. |

FOREIGN PATENT DOCUMENTS

| | | | |
|---|---|---|---|
| JP | 2009053382 | A | 3/2009 |
| JP | 2010256783 | A | 11/2010 |
| WO | WO-2006063448 | A1 | 6/2006 |
| WO | WO-2012137800 | A1 | 10/2012 |

OTHER PUBLICATIONS

Written Opinion of the International Searching Authority PCT/ISA/237 for International Application No. PCT/JP2014/069285 dated Oct. 21, 2014.

* cited by examiner

DISPLAY DEVICE AND METHOD FOR DRIVING SAME

PRIORITY STATEMENT

This application is a divisional application of and claims priority under 35 U.S.C. §§ 120, 121 to U.S. application Ser. No. 14/895,503 filed Dec. 3, 2015, which is a national phase under 35 U.S.C. § 371 of PCT International Application No. PCT/JP2014/069285 which has an International filing date of Jul. 22, 2014, and claims priority under 35 U.S.C. § 119 to Japanese Patent Application No. 2013187218, filed on Sep. 10, 2013, the entire contents of each of which are hereby incorporated herein by reference.

TECHNICAL FIELD

The present invention relates to a display device, and more particularly to a display device including current-driven type light-emitting elements such as organic EL elements, and a method for driving the display device.

BACKGROUND ART

In recent years, an organic EL (Electro Luminescence) display device has been receiving attention as a thin, light-weight, fast response display device. The organic EL display device includes a plurality of pixel circuits arranged two-dimensionally. Each pixel circuit of the organic EL display device includes an organic EL element and a drive transistor. The drive transistor is provided in series with the organic EL element, and controls an amount of current flowing through the organic EL element (hereinafter, referred to as drive current). The organic EL element emits light at a luminance determined according to the amount of drive current.

In the organic EL display device, variations occur in the characteristics (threshold voltage and mobility) of the drive transistors. If variations occur in the characteristics of the drive transistors, then variations occur in the amounts of drive current and accordingly luminance nonuniformity occurs on a display screen. Hence, in order for the organic EL display device to perform high image quality display by suppressing luminance nonuniformity on the display screen, it is necessary to compensate for variations in the characteristics of the drive transistors.

Various types of organic EL display devices that compensate for variations in the characteristics of the drive transistors are known conventionally. For example, Patent Document 1 describes an organic EL display device that reads out a drive current externally via a power supply line, updates a correction gain and a correction offset based on a measured amount of the drive current, and corrects a video signal using the correction gain and the correction offset. Patent Document 2 describes an organic EL display device that reads out a drive current externally via a data line, updates a threshold voltage of a drive transistor based on a result of comparison between a measured amount of the drive current and a target amount, and corrects a video signal using the threshold voltage.

Apart from this, as a low power consumption display device, there is known a display device that performs pause driving (also called intermittent driving or low-frequency driving). The pause driving is a driving method in which, when the same image is continuously displayed, frame periods are classified as a drive period and a pause period, and a drive circuit operates during the drive period and the operation of the drive circuit is stopped during the pause period. The pause driving can be applied when transistors in a pixel circuit have an excellent off-leakage characteristic (small off-leakage current). A display device that performs the pause driving is described in, for example, Patent Document 3.

PRIOR ART DOCUMENTS

Patent Documents

[Patent Document 1] Japanese Laid-Open Patent Publication No. 2005-284172

[Patent Document 2] International Publication No. WO 2006/63448

[Patent Document 3] Japanese Laid-Open Patent Publication No. 2004-78124

SUMMARY OF THE INVENTION

Problems to be Solved by the Invention

In the following, attention is focused on an organic EL display device that reads out a drive current externally via a data line in order to compensate for variations in the characteristics of a drive transistor. In addition, as a display device according to a comparative example, a display device is considered that writes voltages according to a video signal (hereinafter, referred to as data voltages) to pixel circuits in all rows and measures drive currents outputted from pixel circuits in one row, during one frame period. A pixel circuit whose drive current is to be measured is hereinafter referred to as measurement target pixel circuit.

FIG. 18 is a timing chart of the display device according to the comparative example. FIG. 18 describes changes in voltages on scanning lines SL1 to SLm for a case in which pixel circuits in an i-th row are measurement targets. As shown in FIG. 18, in order to write data voltages to the pixel circuits in first to m-th rows in turn, voltages on the scanning lines SL1 to SLm are controlled to a high level in turn for one line period (for a time period Ts1). Note, however, that for the pixel circuits in the i-th row, in order to perform a write of data voltages and a measurement of drive currents, the voltage on the scanning line SLi is controlled to the high level for a time period Ts2 (>Ts1). The time period Ts2 is, for example, about several times longer than the time period Ts1. As such, in the display device according to the comparative example, a selection period of the scanning line SLi corresponding to the measurement target pixel circuits is longer than the selection periods of other scanning lines. In addition, a scanning line whose selection period is longer than other scanning lines is switched every frame period.

A scanning line drive circuit of a display device is generally configured such that flip-flops are connected in multiple stages, a clock signal is supplied to a clock terminal of the flip-flop in each stage, and a start pulse is supplied to an input terminal of the flip-flop in the first stage. However, a scanning line drive circuit of the display device according to the comparative example needs to control voltages on the scanning lines in the manner shown in FIG. 18. Hence, in the display device according to the comparative example, the configuration of the scanning line drive circuit becomes more complex than that of the general display device.

In addition, since the drive current is a very small current of the order of μA or less, to accurately measure the drive current, long measurement time is required. However, in the display device according to the comparative example, since data voltages are written to the pixel circuits in all rows during one frame period, sufficient time for measurement of drive currents cannot be secured. Due to this, the display device according to the comparative example has a problem that the display device cannot sufficiently compensate for variations in the characteristics of the drive transistors and thus cannot sufficiently suppress luminance nonuniformity on a display screen. In addition, the display device according to the comparative example has another problem that, since the display device performs a write of data voltages and a measurement of drive currents during the same frame period, the display device has high peak power consumption.

An object of the present invention is therefore to provide a low power consumption display device that has a scanning line drive circuit with a simple configuration and that is capable of effectively suppressing luminance nonuniformity, and a method for driving the display device.

Means for Solving the Problems

According to a first aspect of the present invention, there is provided a display device having current-driven type light-emitting elements, the display device including: a plurality of pixel circuits arranged corresponding to intersections of a plurality of scanning lines and a plurality of data lines; a drive circuit configured to write voltages to the pixel circuits by driving the scanning lines and the data lines; a measurement circuit configured to measure drive currents outputted to the data lines from the pixel circuits; and a correction circuit configured to correct a video signal based on the drive currents measured by the measurement circuit, wherein each of the pixel circuits includes: a light-emitting element; a drive transistor provided in series with the light-emitting element and configured to output a drive current of an amount according to a voltage between a control terminal and a light-emitting element side conduction terminal of the drive transistor; and an input/output transistor provided between the light-emitting element side conduction terminal of the drive transistor and a corresponding one of the data lines and having a control terminal connected to a corresponding one of the scanning lines, the drive circuit is configured to classify frame periods as a drive period and a pause period, to apply a selection voltage to the scanning lines in turn and apply voltages to be written to the pixel circuits to the data lines in turn during the drive period, and to apply the selection voltage to one or more scanning lines corresponding to measurement target pixel circuits during the pause period, and the measurement circuit is configured to measure drive currents outputted from the measurement target pixel circuits during the pause period.

According to a second aspect of the present invention, in the first aspect of the present invention, the drive circuit is configured to apply voltages according to a corrected video signal to the data lines during a selection period of a scanning line corresponding to pixel circuits that are not measurement targets, in the drive period, and to apply a measurement voltage to the data lines during a selection period of a scanning line corresponding to the measurement target pixel circuits, in the drive period.

According to a third aspect of the present invention, in the second aspect of the present invention, the drive circuit is configured to classify four frame periods as a first drive period, a first pause period, a second drive period, and a second pause period in this order, to apply a first measurement voltage to the data lines during the selection period of the scanning line corresponding to the measurement target pixel circuits in the first drive period, and to apply a second measurement voltage to the data lines during the selection period of the scanning line corresponding to the measurement target pixel circuits in the second drive period, the measurement circuit is configured to measure drive currents outputted from the measurement target pixel circuits as a first drive current during the first pause period, and to measure drive currents outputted from the measurement target pixel circuits as a second drive current during the second pause period, and the correction circuit is configured to correct a portion of the video signal corresponding to the measurement target pixel circuits, based on the first and second drive currents.

According to a fourth aspect of the present invention, in the first aspect of the present invention, the drive circuit is configured to apply voltages according to a corrected video signal to the data lines during a selection period of each scanning line in the drive period, to set a write period and a measurement period in the pause period, and to apply a measurement voltage to the data lines during the write period, and the measurement circuit is configured to measure drive currents outputted from the measurement target pixel circuits during the measurement period.

According to a fifth aspect of the present invention, in the fourth aspect of the present invention, the drive circuit is configured to set a first write period, a first measurement period, a second write period, and a second pause period in this order in the pause period, to apply a first measurement voltage to the data lines during the first write period, and to apply a second measurement voltage to the data lines during the second write period, the measurement circuit is configured to measure drive currents outputted from the measurement target pixel circuits as a first drive current during the first measurement period, and to measure drive currents outputted from the measurement target pixel circuits as a second drive current during the second measurement period, and the correction circuit is configured to correct a portion of the video signal corresponding to the measurement target pixel circuits, based on the first and second drive currents.

According to a sixth aspect of the present invention, in the fifth aspect of the present invention, the drive circuit is configured to set a third write period after the second measurement period in the pause period, and to apply voltages according to the corrected video signal to the data lines during the third write period.

According to a seventh aspect of the present invention, in the second or fourth aspect of the present invention, the drive circuit is configured to apply the selection voltage to one scanning line corresponding to the measurement target pixel circuits during one pause period.

According to an eighth aspect of the present invention, in the second or fourth aspect of the present invention, the drive circuit is configured to apply the selection voltage to a plurality of scanning lines in turn during one pause period, the plurality of scanning lines being corresponding to the measurement target pixel circuits.

According to a ninth aspect of the present invention, in the first aspect of the present invention, the drive circuit is configured to apply voltages according to a corrected video signal to the data lines during a selection period of each scanning line in the drive period, and during a consecutive pause period consisting of a series of the pause periods, to apply the selection voltage to the scanning lines in turn, set a write period and a measurement period in a selection period of each scanning line, and apply a measurement voltage to the data lines during each write period, and the measurement circuit is configured to measure drive currents outputted from the measurement target pixel circuits during each measurement period.

According to a tenth aspect of the present invention, in the ninth aspect of the present invention, the drive circuit is configured to apply the selection voltage to all of the scanning lines in turn during one consecutive pause period.

According to an eleventh aspect of the present invention, in the tenth aspect of the present invention, the drive circuit is configured to apply a first measurement voltage to the data lines during each write period in a first consecutive pause period, and to apply a second measurement voltage to the data lines during each write period in a second consecutive pause period, the measurement circuit is configured to measure drive currents outputted from the measurement target pixel circuits as a first drive current during each measurement period in the first consecutive pause period, and to measure drive currents outputted from the measurement target pixel circuits as a second drive current during each measurement period in the second consecutive pause period, and the correction circuit is configured to correct a portion of the video signal corresponding to the measurement target pixel circuits, based on the first and second drive currents.

According to a twelfth aspect of the present invention, in one of the third, fifth and eleventh aspects of the present invention, the display device further includes a storage unit configured to store, for each of the pixel circuits, first and second correction data to be used to correct the video signal, wherein the correction circuit is configured to update first correction data for the measurement target pixel circuits based on the first drive current, to update second correction data for the measurement target pixel circuits based on the second drive current, and to correct a portion of the video signal corresponding to the measurement target pixel circuits, based on the first and second correction data.

According to a thirteenth aspect of the present invention, in the first aspect of the present invention, the drive circuit includes a first scanning line drive circuit configured to drive the scanning lines during the drive period; and a second scanning line drive circuit configured to drive the scanning lines during the pause period.

According to a fourteenth aspect of the present invention, in the first aspect of the present invention, the drive circuit and the measurement circuit are configured to share drive/measurement circuits corresponding to the data lines, each of the drive/measurement circuits includes an operational amplifier having an inverting input terminal connected to a corresponding one of the data lines; a switching element provided between the inverting input terminal and an output terminal of the operational amplifier; and a passive element provided between the inverting input terminal and output terminal of the operational amplifier and in parallel to the switching element, and the passive element is either one of a capacitive element and a resistive element.

According to a fifteenth aspect of the present invention, there is provided a method for driving a display device including a plurality of pixel circuits arranged corresponding to intersections of a plurality of scanning lines and a plurality of data lines, each of the pixel circuits including a current-driven type light-emitting element; a drive transistor provided in series with the light-emitting element and configured to output a drive current of an amount according to a voltage between a control terminal and a light-emitting element side conduction terminal of the drive transistor; and an input/output transistor provided between the light-emitting element side conduction terminal of the drive transistor and a corresponding one of the data lines and having a control terminal connected to a corresponding one of the scanning lines, the method including: a driving step of writing voltages to the pixel circuits by driving the scanning lines and the data lines; a measuring step of measuring drive currents outputted to the data lines from the pixel circuits; and a correcting step of correcting a video signal based on the measured drive currents, wherein in the driving step, frame periods are classified as a drive period and a pause period, and during the drive period, a selection voltage is applied to the scanning lines in turn and voltages to be written to the pixel circuits are applied to the data lines in turn, and during the pause period, the selection voltage is applied to one or more scanning lines corresponding to measurement target pixel circuits, and in the measuring step, during the pause period, drive currents outputted from the measurement target pixel circuits are measured.

Effects of the Invention

According to the first or fifteenth aspect of the present invention, frame periods are classified as a drive period and a pause period, and drive currents outputted from measurement target pixel circuits to the data lines are measured during the pause period. A scanning line drive circuit that applies a selection voltage to the plurality of scanning lines in turn during the drive period and applies the selection voltage to one or more scanning lines during the pause period has a simple configuration. In addition, by measuring drive currents during the pause period, sufficient time for measurement of drive currents can be secured and variations in the characteristics of the drive transistors can be effectively compensated for, enabling to effectively suppress luminance nonuniformity on a display screen. In addition, by performing a write of voltages and a measurement of drive currents during different frame periods, peak power consumption can be reduced. Therefore, a low power consumption display device that has a scanning line drive circuit with a simple configuration and that is capable of effectively suppressing luminance nonuniformity, or a method for driving the display device can be provided.

According to the second aspect of the present invention, a measurement voltage is written to the measurement target pixel circuits during the drive period. Therefore, drive currents outputted from the pixel circuits to which the measurement voltage has been written can be measured during the subsequent pause period.

According to the third aspect of the present invention, each of a write of a measurement voltage and a measurement of a drive current is performed twice on the measurement target pixel circuit during four frame periods, and a video signal is corrected based on two measurement results. Therefore, variations in two types of characteristics (e.g., threshold voltage and mobility) of a drive transistor can be compensated for, enabling to effectively suppress luminance nonuniformity on a display screen.

According to the fourth aspect of the present invention, a measurement voltage is written to the measurement target pixel circuits during a write period in the pause period. Therefore, drive currents outputted from the pixel circuits to which the measurement voltage has been written can be measured during the subsequent measurement period.

According to the fifth aspect of the present invention, each of a write of a measurement voltage and a measurement of a drive current is performed twice on a measurement target pixel circuit during one frame period, and a video signal is corrected based on two measurement results. Therefore, variations in two types of characteristics of a drive transistor can be compensated for, enabling to effectively suppress luminance nonuniformity on a display screen.

According to the sixth aspect of the present invention, during a third write period, voltages according to a video signal which is corrected based on measurement results obtained during the first and second measurement periods are written to the measurement target pixel circuits. Therefore, results of compensating for variations in the characteristics of drive transistors can be immediately reflected in a display image.

According to the seventh aspect of the present invention, variations in the characteristics of drive transistors in a plurality of pixel circuits connected to one scanning line can be compensated for during one pause period.

According to the eighth aspect of the present invention, variations in the characteristics of drive transistors in a plurality of pixel circuits connected to a plurality of scanning lines can be compensated for during one pause period.

According to the ninth aspect of the present invention, a measurement voltage is written to the measurement target pixel circuits during each write period in a consecutive pause period. Therefore, drive currents outputted from the pixel circuits to which the measurement voltage has been written can be measured during the subsequent measurement period.

According to the tenth aspect of the present invention, variations in the characteristics of the drive transistors in all of the pixel circuits can be compensated for during one consecutive pause period.

According to the eleventh aspect of the present invention, each of a write of a measurement voltage and a measurement of a drive current is performed twice on all of the pixel circuits during two consecutive pause periods, and a video signal is corrected based on two measurement results. Therefore, variations in two types of characteristics of the drive transistors can be compensated for, enabling to effectively suppress luminance nonuniformity on a display screen.

According to the twelfth aspect of the present invention, two pieces of correction data are stored for each pixel circuit, the two pieces of correction data are updated based on two measurement results, and a video signal is corrected based on the two pieces of correction data. By this, variations in two types of characteristics of a drive transistor can be compensated for, enabling to effectively suppress luminance nonuniformity on a display screen.

According to the thirteenth aspect of the present invention, by dividing a circuit into a circuit that operates during the drive period and a circuit that operates during the pause period, a scanning line drive circuit can be easily formed.

According to the fourteenth aspect of the present invention, each drive/measurement circuit applies a voltage which is provided to a non-inverting input terminal of an operational amplifier, to a data line when a switching element is in an on state, and outputs a voltage according to a drive current which is outputted to the data line, from an output terminal of the operational amplifier when the switching element is in an off state. Therefore, using the drive/current measurement circuits, the drive circuit that writes voltages to the pixel circuits and the measurement circuit that measures drive currents outputted to the data lines from the pixel circuits can be easily formed.

MODES FOR CARRYING OUT THE INVENTION

First Embodiment

Figure 1:
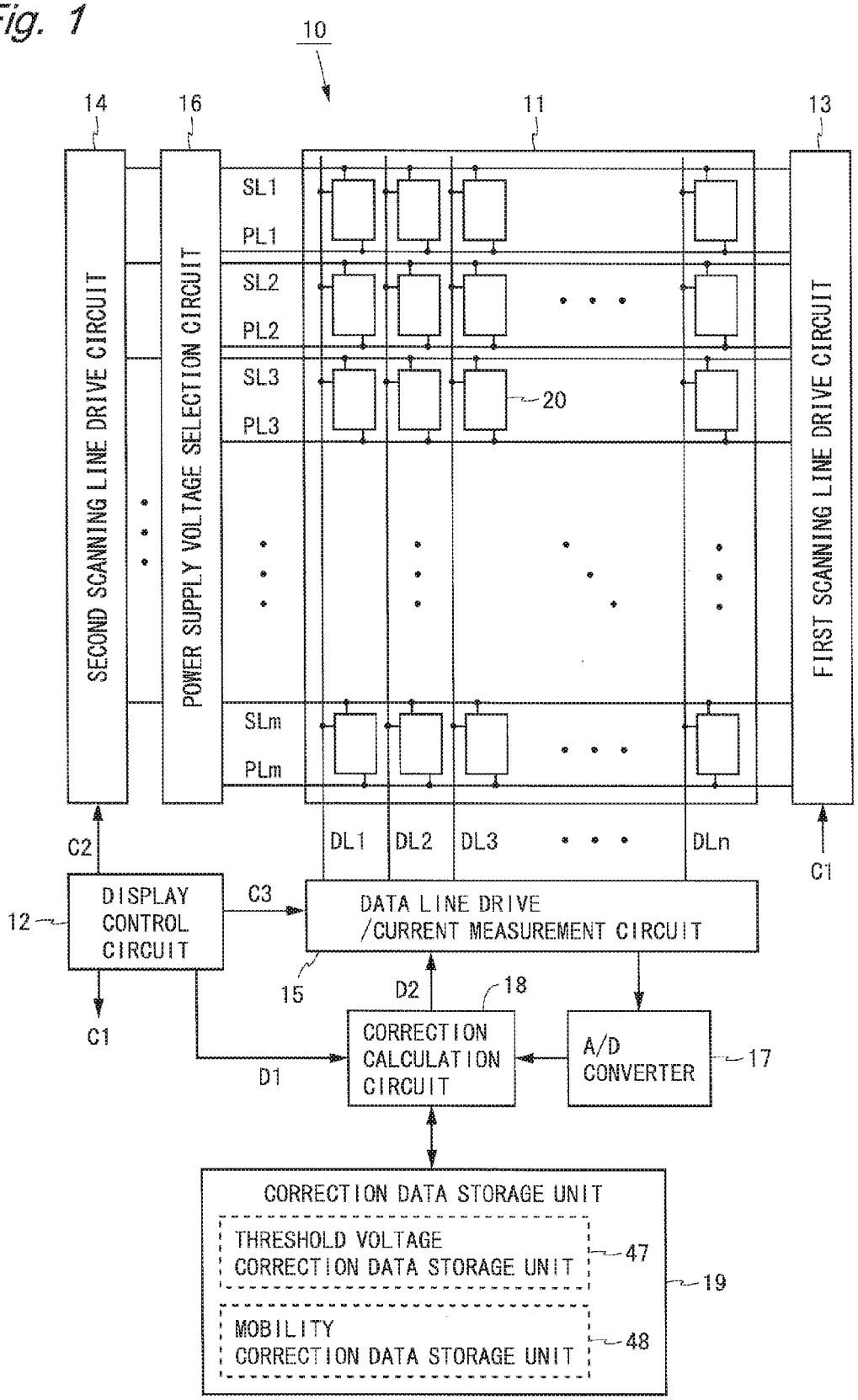
FIG. 1 is a block diagram showing a configuration of a display device according to a first embodiment of the present invention.

FIG. 1 is a block diagram showing a configuration of a display device according to a first embodiment of the present invention. A display device 10 shown in FIG. 1 is an organic EL display device including a display unit 11, a display control circuit 12, a first scanning line drive circuit 13, a second scanning line drive circuit 14, a data line drive/current measurement circuit 15, a power supply voltage selection circuit 16, an A/D converter 17, a correction calculation circuit 18, and a correction data storage unit 19. In the following, m and n are integers greater than or equal to 2, i is an integer between 1 and m, inclusive, and j is an integer between 1 and n, inclusive.

The display unit 11 includes m scanning lines SL1 to SLm, n data lines DL1 to DLn, m power supply lines PL1 to PLm, and (m×n) pixel circuits 20. The scanning lines SL1 to SLm and the power supply lines PL1 to PLm are arranged parallel to each other. The data lines DL1 to DLn are arranged parallel to each other so as to be orthogonal to the scanning lines SL1 to SLm. The scanning lines SL1 to SLm intersect the data lines DL1 to DLn at (m×n) points. The (m×n) pixel circuits 20 are arranged at the intersections of the scanning lines SL1 to SLm and the data lines DL1 to DLn. A direction in which the scanning lines SL1 to SLm extend (a horizontal direction in FIG. 1) is hereinafter referred to as row direction, a direction in which the data lines DL1 to DLn extend (a vertical direction in FIG. 1) is hereinafter referred to as column direction, and a pixel circuit 20 in an i-th row and a j-th column is hereinafter referred to as PX(i, j).

The first scanning line drive circuit 13 is arranged along one side of the display unit 11 (the right side in FIG. 1). The second scanning line drive circuit 14 and the power supply voltage selection circuit 16 are arranged along an opposite side of the display unit 11 (the left side in FIG. 1). The data line drive/current measurement circuit 15 is arranged along one of the remaining sides of the display unit 11 (the lower side in FIG. 1).

[The display control circuit 12 outputs control signals to control the operation of the display device 10. More specifically, the display control circuit 12 outputs a control signal C1 to the first scanning line drive circuit 13, outputs a control signal C2 to the second scanning line drive circuit 14, and outputs a control signal C3 to the data line drive/current measurement circuit 15. In addition, the display control circuit 12 outputs a video signal D1 (pre-correction video signal) to the correction calculation circuit 18.

The first scanning line drive circuit 13 and the second scanning line drive circuit 14 drive the scanning lines SL1 to SLm. The data line drive/current measurement circuit 15 selectively performs the operation of driving the data lines DL1 to DLn and the operation of measuring drive currents which are outputted to the data lines DL1 to DLn from the pixel circuits 20. The first scanning line drive circuit 13, the second scanning line drive circuit 14, and the data line drive/current measurement circuit 15 function as a drive circuit that writes voltages to the pixel circuits 20 by driving the scanning lines SL1 to SLm and the data lines DL1 to DLn. The data line drive/current measurement circuit 15 also functions as a measurement circuit that measures drive currents which are outputted to the data lines DL1 to DLn from the pixel circuits 20. The power supply voltage selection circuit 16 selectively applies a first low-level power supply voltage ELVSS for display and a second low-level power supply voltage ELVSS_moni for current measurement to the power supply lines PL1 to PLm. To each pixel circuit 20 are supplied a high-level power supply voltage ELVDD and a reference voltage Vref from a power supply circuit which is not shown.

The correction data storage unit 19 stores two types of correction data to be used to correct the video signal D1. More specifically, the correction data storage unit 19 includes a threshold voltage correction data storage unit 47 and a mobility correction data storage unit 48. The threshold voltage correction data storage unit 47 stores, for each pixel circuit PX(i, j), threshold voltage correction data Vt(i, j). The mobility correction data storage unit 48 stores, for each pixel circuit PX(i, j), mobility correction data B(i, j).

The data line drive/current measurement circuit 15 outputs voltages according to drive currents which are outputted to the data lines DL1 to DLn from the pixel circuits 20. The A/D converter 17 converts the voltages outputted from the data line drive/current measurement circuit 15 into digital values. The digital values indicate the amounts of the drive currents outputted from the pixel circuits 20. The correction calculation circuit 18 updates the correction data stored in the correction data storage unit 19, based on the digital values outputted from the A/D converter 17. In addition, the correction calculation circuit 18 corrects the video signal D1 by referring to the correction data stored in the correction data storage unit 19, and outputs a corrected video signal D2. The data line drive/current measurement circuit 15 drives the data lines DL1 to DLn based on the corrected video signal D2.

Figure 2:
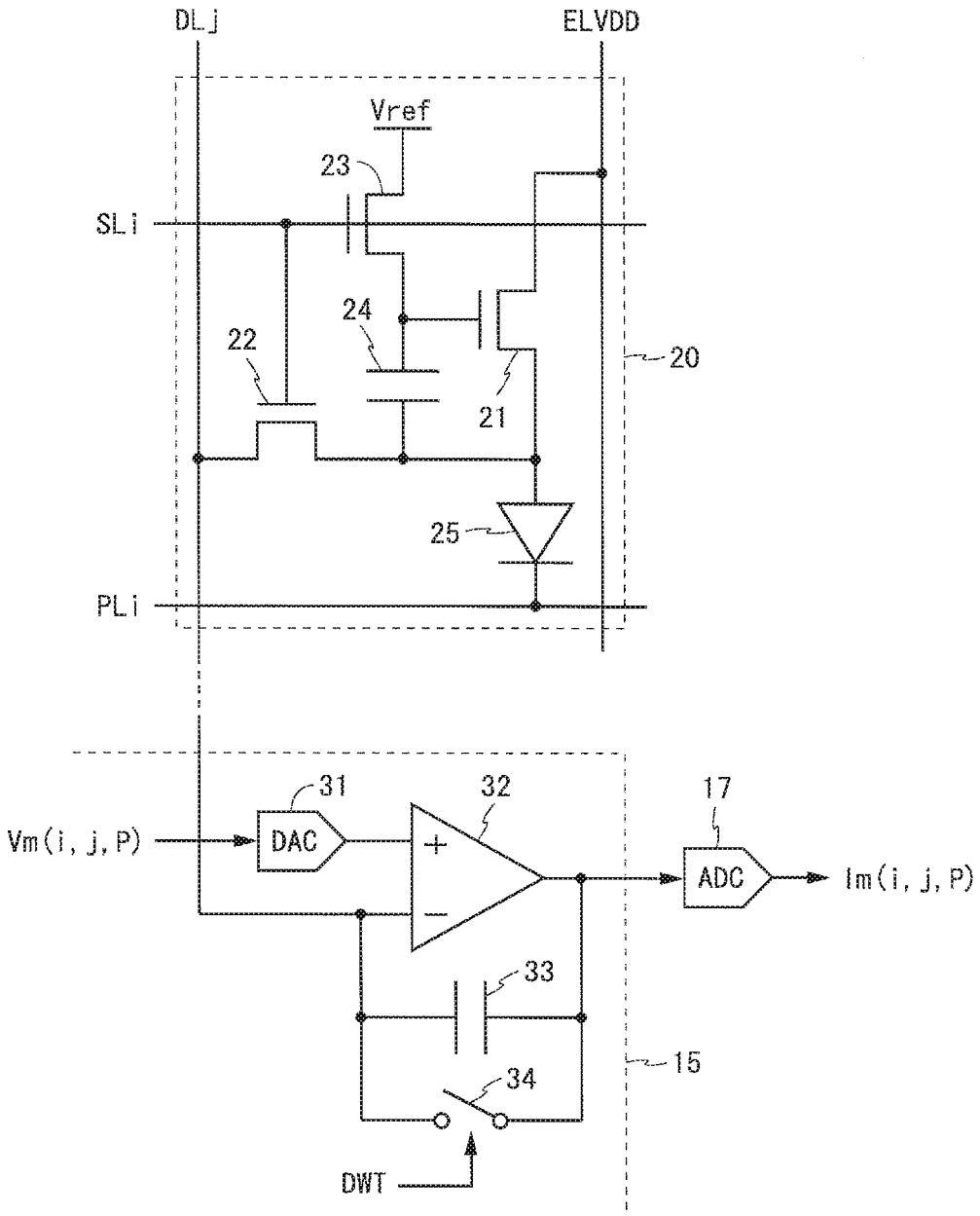
FIG. 2 is a circuit diagram showing a pixel circuit and a part of a data line drive/current measurement circuit of the display device shown in FIG. 1.

FIG. 2 is a circuit diagram showing the pixel circuit 20 and a part of the data line drive/current measurement circuit 15. FIG. 2 describes a pixel circuit PX(i, j) in an i-th row and a j-th column, and a portion of the data line drive/current measurement circuit 15 corresponding to a data line DLj. As shown in FIG. 2, the pixel circuit 20 includes N-channel TFTs (Thin Film Transistors) 21 to 23, a capacitor 24, and an organic EL element 25. For the TFTs 21 to 23, TFTs with an excellent off-leakage characteristic are used. For the TFTs 21 to 23, for example, TFTs having a semiconductor layer which is formed of indium-gallium-zinc oxide (IGZO) are used.

The high-level power supply voltage ELVDD is applied to a drain terminal of the TFT 21. A source terminal of the TFT 21 is connected to an anode terminal of the organic EL element 25, and a cathode terminal of the organic EL element 25 is connected to a power supply line PLi. One conduction terminal of the TFT 22 is connected to the data line DLj, and the other conduction terminal of the TFT 22 is connected to the source terminal of the TFT 21. The reference voltage Vref is applied to a drain terminal of the TFT 23, and a source terminal of the TFT 23 is connected to a gate terminal of the TFT 21. A gate terminal of the TFT 22 and a gate terminal of the TFT 23 are connected to a scanning line SLi. The capacitor 24 is provided between the gate terminal and source terminal of the TFT 21.

The organic EL element 25 is a current-driven type light-emitting element. The TFT 21 is provided in series with the organic EL element 25, and functions as a drive transistor that outputs a drive current of an amount determined according to a gate-source voltage of the TFT 21. The TFT 22 is provided between the source terminal of the TFT 21 and the data line DLj, and functions as an input/output transistor having a gate terminal connected to the scanning line SLi. The TFT 23 is provided between a wiring line having the reference voltage Vref and the gate terminal of the TFT 21, and functions as a reference voltage application transistor having a gate terminal connected to the scanning line SLi. The capacitor 24 functions as a holding capacitor that holds a gate-source voltage of the TFT 21.

The data line drive/current measurement circuit 15 includes a D/A converter 31, an operational amplifier 32, a capacitor 33, and a switch 34 corresponding to the data line DLj. A data voltage value Vm(i, j, P) which is included in the video signal D2 is provided to an input terminal of the D/A converter 31. The D/A converter 31 converts the data voltage value Vm(i, j, P) into an analog data voltage (represented as Vm(i, j, P) in the same manner as the data voltage value). An output terminal of the D/A converter 31 is connected to a non-inverting input terminal of the operational amplifier 32. An inverting input terminal of the operational amplifier 32 is connected to the data line DLj. The switch 34 is provided between the inverting input terminal and output terminal of the operational amplifier 32. The capacitor 33 is provided between the inverting input terminal and output terminal of the operational amplifier 32 and in parallel to the switch 34. An input/output control signal DWT which is included in the control signal C3 is provided to a control terminal of the switch 34. The output terminal of the operational amplifier 32 is connected to an input terminal of an A/D converter 17.

When the input/output control signal DWT is at a high level, the switch 34 goes to an on state, and the inverting input terminal and output terminal of the operational amplifier 32 are short-circuited. At this time, the operational amplifier 32 functions as a buffer amplifier, and the data voltage Vm(i, j, P) provided to the non-inverting input terminal of the operational amplifier 32 is applied to the data line DLj. When the input/output control signal DWT is at a low level, the switch 34 goes to an off state, and the inverting input terminal and output terminal of the operational amplifier 32 are connected to each other through the capacitor 33. At this time, the operational amplifier 32 and the capacitor 33 function as an integrating circuit, and an output voltage from the operational amplifier 32 is a voltage according to a drive current outputted to the data line DLj from the pixel circuit 20. The A/D converter 17 converts the output voltage from the operational amplifier 32 into a digital value. The drive current measured by the data line drive/current measurement circuit 15 is hereinafter referred to as Im(i, j, P), and the digital value outputted from the A/D converter 17 is hereinafter referred to as drive current value and represented as Im(i, j, P) in the same manner as the drive current.

The display device 10 performs pause driving where frame periods are classified as a drive period and a pause period. The display device 10 writes display data voltages to the pixel circuits 20 during the drive period and does not write display data voltages to the pixel circuits 20 during the pause period. In addition, during the pause period, the display device 10 measures drive currents which are outputted to the data lines DL1 to DLn from pixel circuits 20 in one row, and updates correction data stored in the correction data storage unit 19, based on drive current values.

More specifically, in the display device 10, a first gradation P1 and a second gradation P2 (>P1) are predetermined within a range of display gradations. The data line drive/current measurement circuit 15 generates a first measurement voltage Vm(i, j, P1) to write the first gradation P1 to a pixel circuit PX(i, j), and measures a drive current outputted from the pixel circuit PX(i, j) to which the first measurement voltage Vm(i, j, P1) has been written, as a first drive current Im(i, j, P1). The correction calculation circuit 18 updates threshold voltage correction data Vt(i, j) stored in the threshold voltage correction data storage unit 47, based on a drive current value obtained at this time (hereinafter, referred to as first drive current value Im(i, j, P1)). In addition, the data line drive/current measurement circuit 15 generates a second measurement voltage Vm(i, j, P2) to write the second gradation P2 to the pixel circuit PX(i, j), and measures a drive current outputted from the pixel circuit PX(i, j) to which the second measurement voltage Vm(i, j, P2) has been written, as a second drive current Im(i, j, P2). The correction calculation circuit 18 updates mobility correction data B(i, j) stored in the mobility correction data storage unit 48, based on a drive current value obtained at this time (hereinafter, referred to as second drive current value Im(i, j, P2)).

Figure 3:
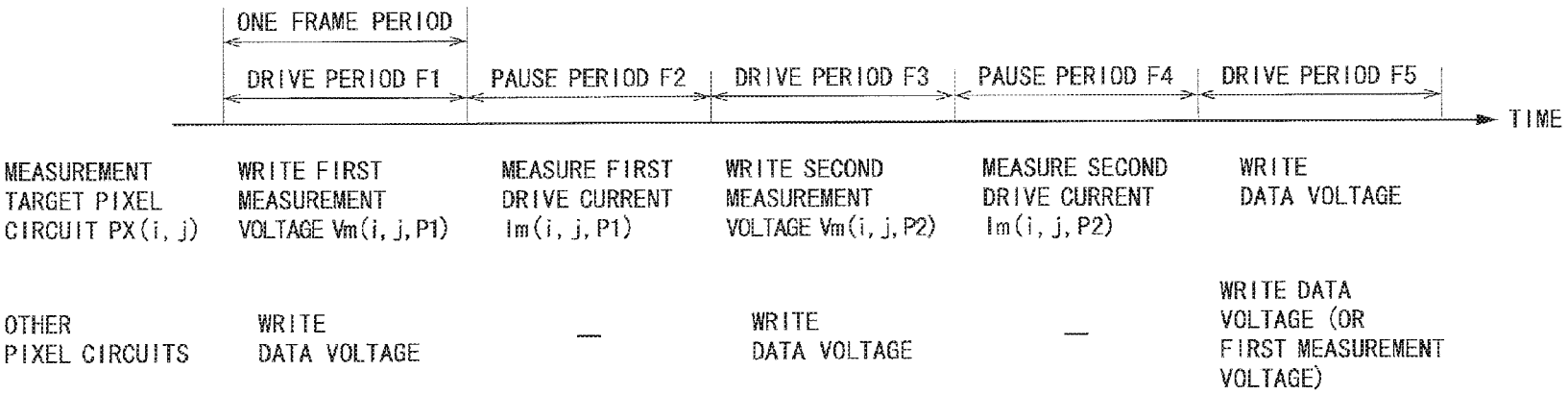
FIG. 3 is a diagram showing the operation of the display device shown in FIG. 1 which is performed during drive periods and pause periods.

The display device 10 performs pause driving where a drive period and a pause period are switched alternately every frame period. FIG. 3 is a diagram showing the operation of the display device 10 performed during drive periods and pause periods. As shown in FIG. 3, the drive circuit of the display device 10 classifies four consecutive frame periods F1 to F4 as a first drive period F1, a first pause period F2, a second drive period F3, and a second pause period F4, and classifies a frame period subsequent to the second pause period F4 as a third drive period F5.

During the first drive period F1, the display device 10 writes a first measurement voltage Vm(i, j, P1) to a measurement target pixel circuit PX(i, j), and writes display data voltages to other pixel circuits. During the first pause period F2, the display device 10 measures a first drive current Im(i, j, P1) outputted from the measurement target pixel circuit PX(i, j). During the second drive period F3, the display device 10 writes a second measurement voltage Vm(i, j, P2) to the measurement target pixel circuit PX(i, j), and writes display data voltages to other pixel circuits. During the second pause period F4, the display device 10 measures a second drive current Im(i, j, P2) outputted from the measurement target pixel circuit PX(i, j). During the third drive period F5, the display device 10 writes a first measurement voltage to a next measurement target pixel circuit, and writes display data voltages to other pixel circuits (including the pixel circuit PX(i, j)). Note that the data voltage written to the pixel circuit PX(i, j) during the third drive period F5 is a voltage based on the corrected video signal D2 which is obtained by updating two types of correction data stored in the correction data storage unit 19, based on the first drive current value Im(i, j, P1) and the second drive current value Im(i, j, P2), and referring to the updated correction data.

Figure 4:
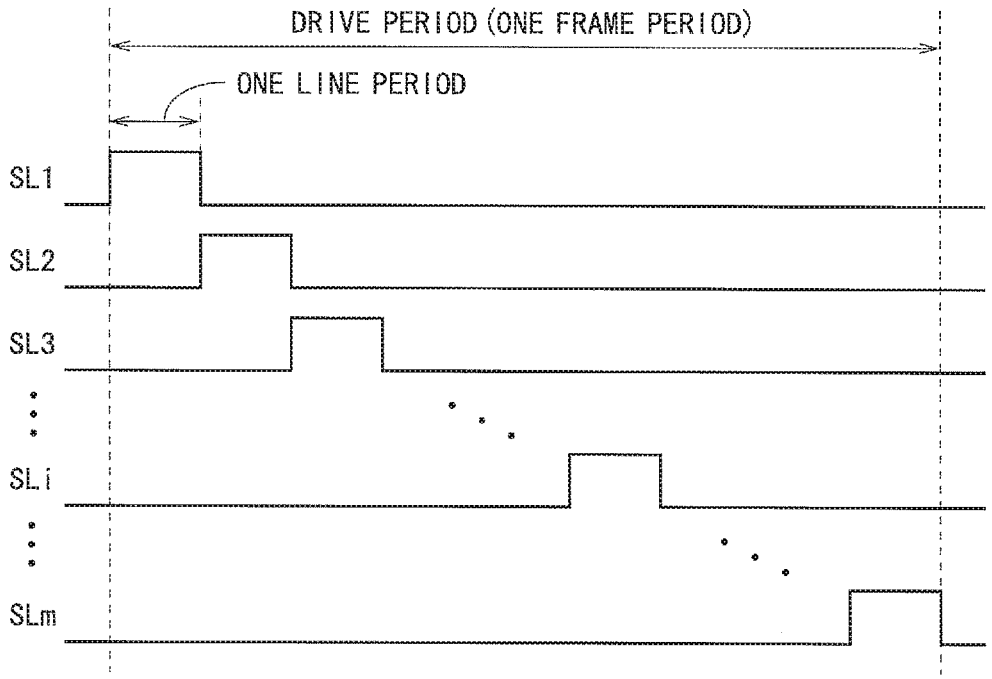
FIG. 4 is a timing chart of a drive period of the display device shown in FIG. 1.

FIG. 4 is a timing chart of a drive period of the display device 10. During the drive period, the operation of the second scanning line drive circuit 14 is stopped. The first scanning line drive circuit 13 selects the scanning lines SL1 to SLm in turn for one line period, and applies a selection voltage (here, a high-level voltage) to the selected scanning line. The data line drive/current measurement circuit 15 applies n data voltages based on the corrected video signal D2, to the data lines DL1 to DLn, respectively. Note, however, that when pixel circuits in an i-th row are measurement targets, the data line drive/current measurement circuit 15 applies first measurement voltages Vm(i, 1, P1) to Vm(i, n, P1) or second measurement voltages Vm(i, 1, P2) to Vm (i, n, P2) to the data lines DL1 to DLn, respectively, during a selection period of a scanning line SLi. The power supply voltage selection circuit 16 applies the first low-level power supply voltage ELVSS to the power supply lines PL1 to PLm. As such, during the drive period, pixel circuits 20 in one row are selected in turn for one line period, and data voltages or measurement voltages are written to the pixel circuits 20 in the selected row. By this, data voltages or measurement voltages can be written to all of the pixel circuits 20 during one drive period.

Figure 5:
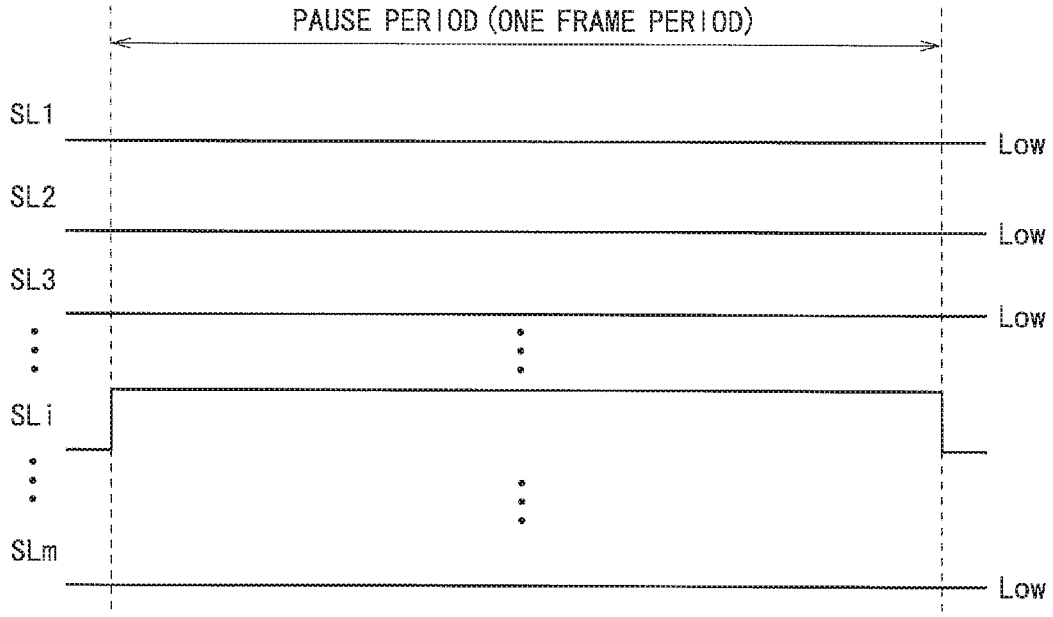
FIG. 5 is a timing chart of a pause period of the display device shown in FIG. 1.

FIG. 5 is a timing chart of a pause period of the display device 10. During the pause period, the operation of the first scanning line drive circuit 13 is stopped. When pixel circuits in the i-th row are measurement targets, the second scanning line drive circuit 14 applies the selection voltage to the scanning line SLi over one frame period. The power supply voltage selection circuit 16 applies the second low-level power supply voltage ELVSS_moni to the power supply line PLi, and applies the first low-level power supply voltage ELVSS to other power supply lines. The data line drive/current measurement circuit 15 measures drive currents outputted to the data lines DL1 to DLn from the measurement target pixel circuits 20. By this, n drive currents outputted from n pixel circuits 20 can be measured during one pause period.

The data line drive/current measurement circuit 15 measures the first drive current Im(i, j, P1) during the first pause period F2, and measures the second drive current Im(i, j, P2) during the second pause period F4. The measurement target pixel circuits are switched every two pause periods. By this, during 2 m pause periods, two types of correction data for all of the pixel circuits 20 which are stored in the correction data storage unit 19 can be updated.

Figure 6:
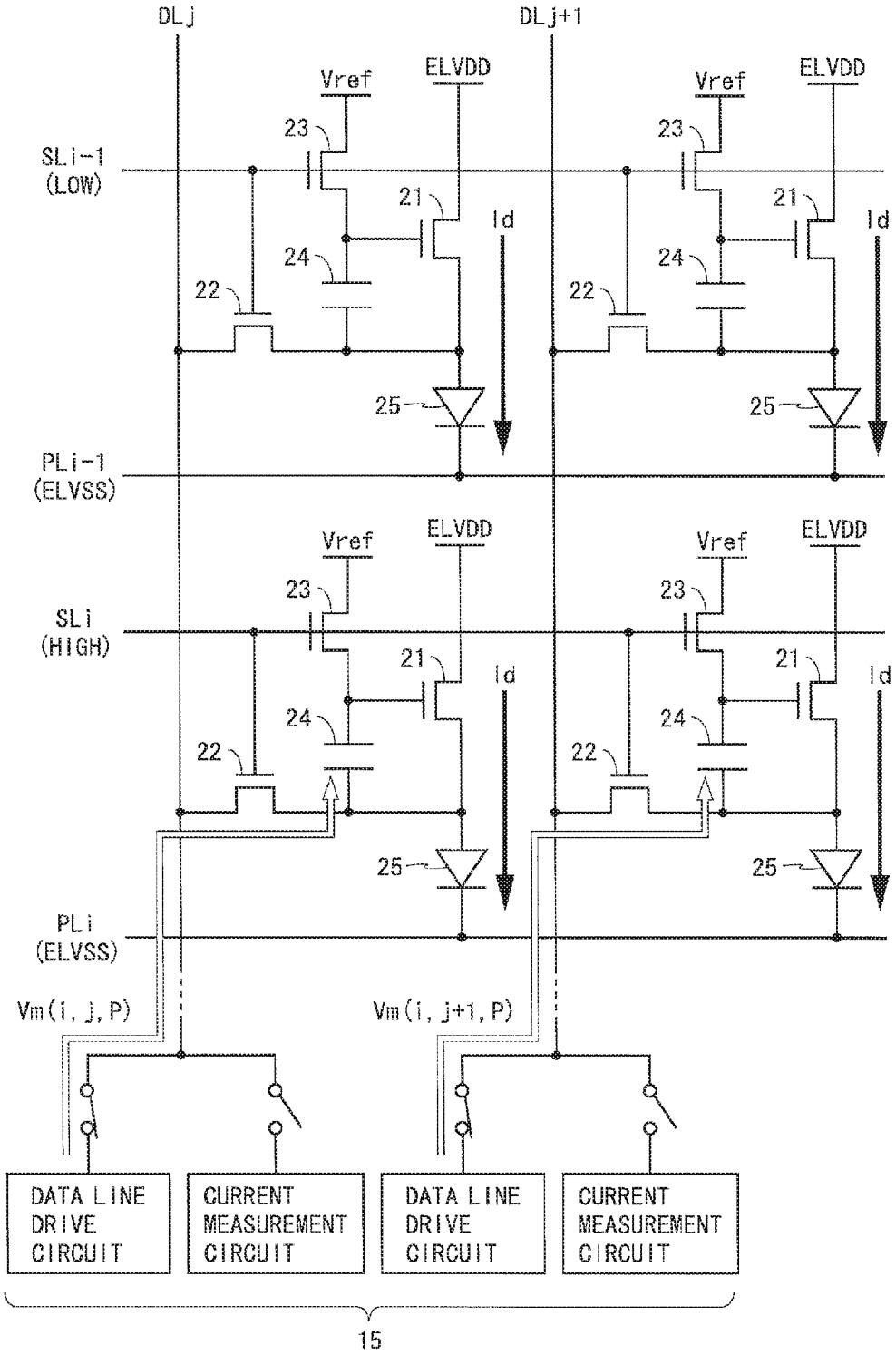
FIG. 6 is a diagram showing voltage write operation of the display device shown in FIG. 1.

FIG. 6 is a diagram showing voltage write operation of the display device 10. Voltage write operation for the pixel circuit PX(i, j) will be described below. The voltage write is performed during the drive period. During the drive period, the first low-level power supply voltage ELVSS is applied to the power supply line PLi. During the selection period of the pixel circuits 20 in the i-th row, a voltage on the scanning line SLi goes to the high level and voltages on other scanning lines go to the low level (see FIG. 4). A data voltage Vm (i, j, P) to write a gradation P to the pixel circuit PX(i, j) is applied to the data line DLj. Note, however, that when the pixel circuits 20 in the i-th row are measurement targets, a first measurement voltage Vm(i, j, P1) or a second measurement voltage Vm(i, j, P2) is applied to the data line DLj. When the voltage on the scanning line SLi is changed to the high level, the TFTs 22 and 23 go to the on state. Hence, the voltage on the data line DLj is applied through the TFT 22 to the source terminal of the TFT 21, and the reference voltage Vref is applied through the TFT 23 to the gate terminal of the TFT 21.

At this time, a drive current Id flows between the drain and source of the TFT 21, and the organic EL element 25 emits light at a luminance according to the drive current Id. The amount of the drive current Id and the luminance of the organic EL element 25 depend on the gate-source voltage Vgs of the TFT 21, the high-level power supply voltage ELVDD, and the first low-level power supply voltage ELVSS.

When the voltage on the scanning line SLi is changed to the low level thereafter, the TFTs 22 and 23 go to the off state. Still after this, the gate-source voltage Vgs of the TFT 21 is maintained at the existing level by the action of the capacitor 24. Therefore, the organic EL element 25 continuously emits light at a luminance according to the gate-source voltage Vgs of the TFT 21.

Figure 7:
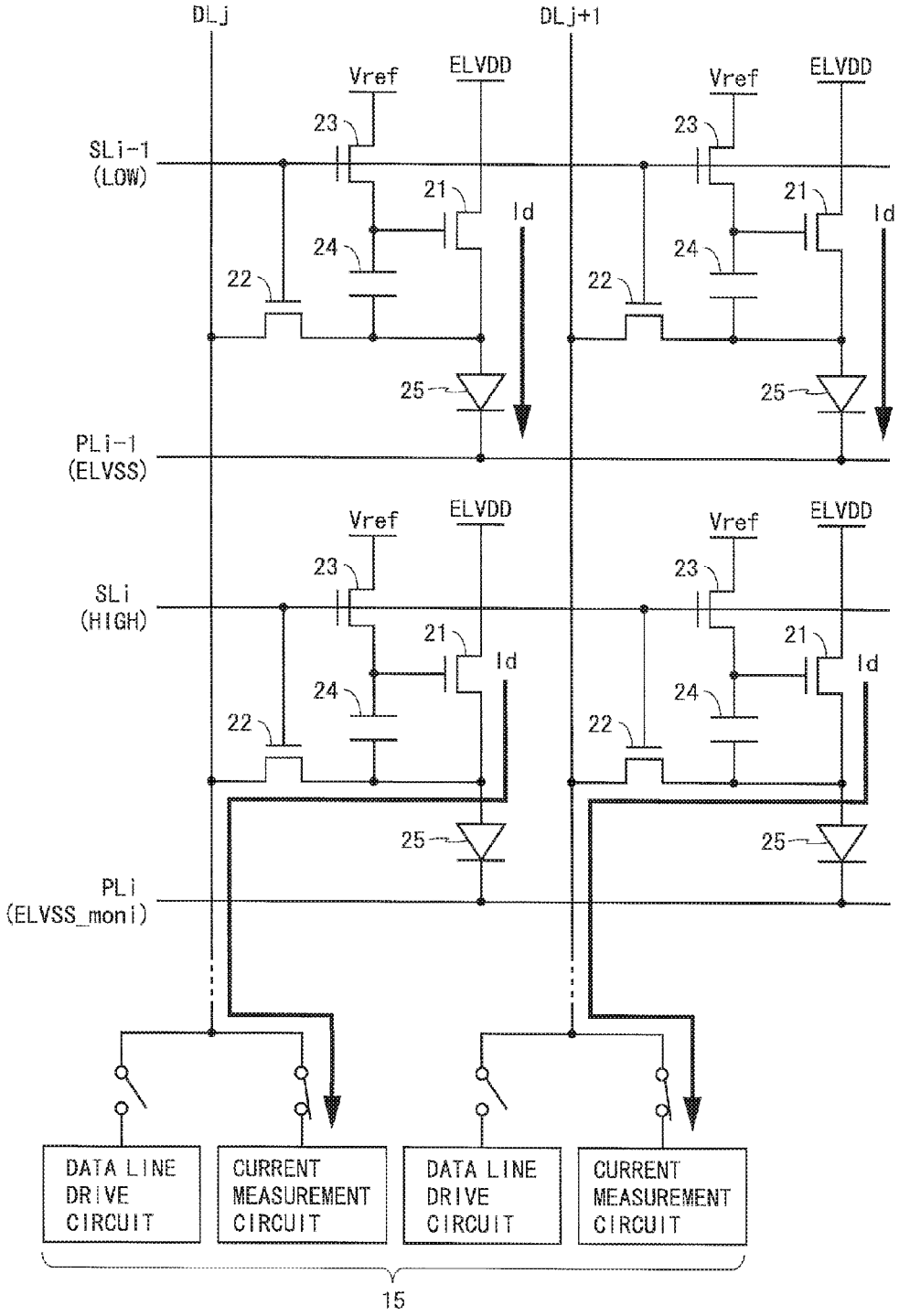
FIG. 7 is a diagram showing current measurement operation of the display device shown in FIG. 1.

FIG. 7 is a diagram showing current measurement operation of the display device 10. Current measurement operation for the pixel circuit PX(i, j) will be described below. The current measurement is performed during the pause period. When the pixel circuits 20 in the i-th row are measurement targets, during the pause period, a voltage on the scanning line SLi goes to the high level, and voltages on other scanning lines go to the low level (see FIG. 5). The second low-level power supply voltage ELVSS_moni is applied to the power supply line PLi, and the first low-level power supply voltage ELVSS is applied to other power supply lines. When the source voltage of the TFT 21 is Vs and the light emission threshold voltage of the organic EL element 25 is Vt_oled, the second low-level power supply voltage ELVSS_moni is determined so as to satisfy the following equation (1):

$$|Vs-\text{ELVSS_moni}|<|Vt_\text{oled}| \quad (1)$$

When the voltage on the scanning line SLi is changed to the high level, the TFTs 22 and 23 go to the on state. At this time, a drive current Id flows between the drain and source of the TFT 21. The amount of the drive current Id depends on the gate-source voltage Vgs of the TFT 21, the high-level power supply voltage ELVDD, and the second low-level power supply voltage ELVSS_moni. Note, however, that since equation (1) holds, the drive current Id does not flow through the organic EL element 25, but flows through the data line drive/current measurement circuit 15 via the TFT 22 and the data line DLj. The data line drive/current measurement circuit 15 measures the drive current Id outputted from the pixel circuit PX(i, j), and outputs a result of the measurement as the first drive current Im(i, j, P1) or the second drive current Im(i, j, P2).

When the voltage on the scanning line SLi is changed to the low level thereafter, the TFTs 22 and 23 go to the off state. The state of the pixel circuit PX(i, j) does not change until the voltage on the scanning line SLi is changed to the high level next time.

Figure 8:
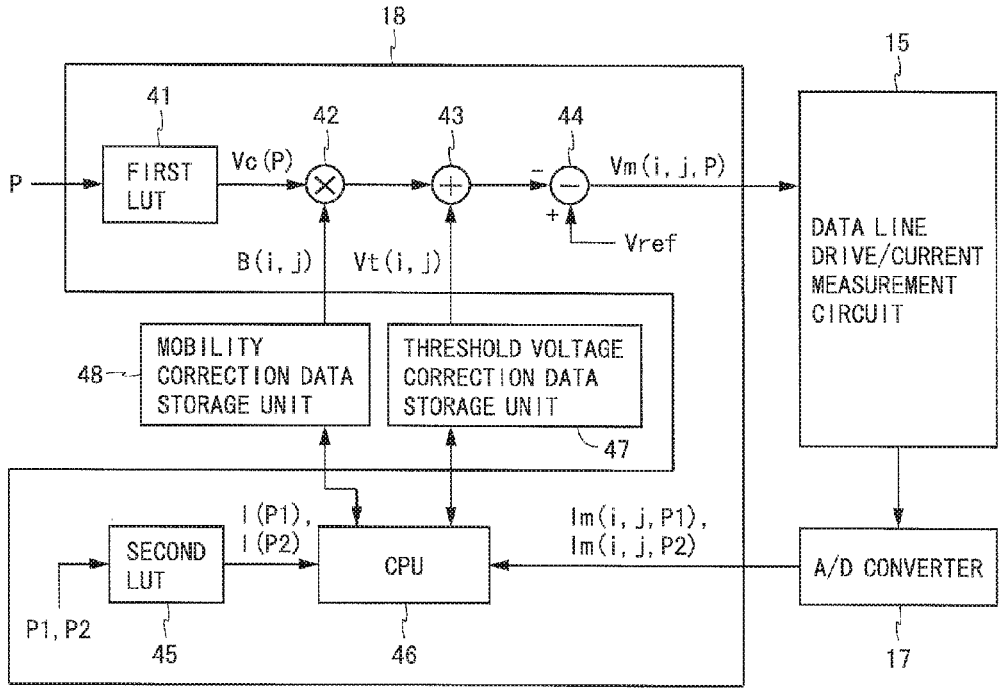
FIG. 8 is a block diagram showing details of a correction calculation circuit of the display device shown in FIG. 1.

FIG. 8 is a block diagram showing details of the correction calculation circuit 18. As shown in FIG. 8, the correction calculation circuit 18 includes a first LUT 41, a multiplier 42, an adder 43, a subtractor 44, a second LUT 45, and a CPU 46. In FIG. 8, a reference character P indicates a gradation included in the video signal D1. The correction calculation circuit 18 performs the operation of correcting the video signal D1 by referring to two types of correction data stored in the correction data storage unit 19, and the operation of updating two types of correction data stored in the correction data storage unit 19, based on two drive current values outputted from the A/D converter 17. The correction calculation circuit 18 functions as a correction circuit that corrects a video signal based on drive currents measured by a measurement circuit (data line drive/current measurement circuit 15). Note that the CPU 46 may be composed of a calculation circuit.

The first LUT 41 stores an overdrive voltage Vc(P) for each display gradation P. The first LUT 41 converts the gradation P included in the video signal D1 into an overdrive voltage Vc(P). The multiplier 42 multiplies the overdrive voltage Vc(P) by mobility correction data B(i, j) which is read out from the mobility correction data storage unit 48. The adder 43 adds an output from the multiplier 42 to threshold voltage correction data Vt(i, j) which is read out from the threshold voltage correction data storage unit 47. The subtractor 44 subtracts an output from the adder 43 from the value of the reference voltage Vref. By this, correction calculation shown in the following equation (2) is performed on the gradation P included in the video signal D1:

$$Vm(i,j,P)=V\text{ref}-Vc(P)\times B(i,j)-Vt(i,j) \quad (2)$$

The correction calculation circuit 18 outputs the corrected video signal D2 including the obtained data voltage value Vm(i, j, P). The data line drive/current measurement circuit 15 drives the data lines DL1 to DLn based on the corrected video signal D2.

The second LUT 45 stores a first target current value I(P1) for the first gradation P1 and a second target current value I(P2) for the second gradation P2. The second LUT 45 outputs the first target current value I(P1) during the first pause period F2, and outputs the second target current value I(P2) during the second pause period F4.

The CPU 46 receives the first drive current value Im(i, j, P1) from the A/D converter 17 during the first pause period F2, and receives the second drive current value Im(i, j, P2) from the A/D converter 17 during the second pause period F4. When the CPU 46 receives the first drive current value Im(i, j, P1), the CPU 46 compares the first drive current value Im(i, j, P1) with the first target current value I(P1), and updates threshold voltage correction data Vt(i, j) stored in the threshold voltage correction data storage unit 47, according to a result of the comparison. More specifically, when an amount of update is ΔV and a dead zone width is V_dz, the CPU 46 adds ΔV to the threshold voltage correction data Vt (i, j) when the following equation (3) holds, subtracts ΔV from the threshold voltage correction data Vt(i, j) when the following equation (4) holds, and does not update the threshold voltage correction data Vt(i, j) when the following equation (5) holds. The first drive current value Im(i, j, P1) approaches the first target current value I(P1) in a stepwise manner, and ultimately converges to the first target current value I(P1).

$$I(P1)-Im(i,j,P1)>V_dz \quad (3)$$

$$I(P1)-Im(i,j,P1)<-V_dz \quad (4)$$

$$|I(P1)-Im(i,j,P1)|<=V_dz \quad (5)$$

In addition, when the CPU 46 receives the second drive current value Im(i, j, P2), the CPU 46 compares the second drive current value Im(i, j, P2) with the second target current value I(P2), and updates mobility correction data B(i, j) stored in the mobility correction data storage unit 48, according to a result of the comparison. More specifically, when an amount of update is ΔB and a dead zone width is B_dz, the CPU 46 adds ΔB to the mobility correction data B(i, j) when the following equation (6) holds, subtracts ΔB from the mobility correction data B(i, j) when the following equation (7) holds, and does not update the mobility correction data B(i, j) when the following equation (8) holds. The second drive current value Im(i, j, P2) approaches the second target current value I(P2) in a stepwise manner, and ultimately converges to the second target current value I(P2).

$$I(P2)-Im(i,j,P2)>B_dz \quad (6)$$

$$I(P2)-Im(i,j,P2)<-B_dz \quad (7)$$

$$|I(P2)-Im(i,j,P2)|<=B_dz \quad (8)$$

Note that an initial value of the threshold voltage correction data Vt(i, j) is a predetermined voltage value and an initial value of the mobility correction data B(i, j) is 1.

It is assumed that the threshold voltage of the TFT 21 is Vt and the gain of the TFT 21 is β. When the TFT 21 operates in a saturation region, the amount of drive current Id flowing between the drain and source of the TFT 21 is represented by the following equation (9) using the gate-source voltage Vgs of the TFT 21:

$$Id=\beta/2\times(Vgs-Vt)2 \quad (9)$$

The reference voltage Vref is applied to the gate terminal of the TFT 21, and the data voltage Vm(i, j, P) is applied to the source terminal of the TFT 21. Hence, equation (9) can be modified to the following equation (10):

$$Id=\beta/2\times(Vref-Vm(i,j,P)-Vt)2 \quad (10)$$

When equation (2) is substituted into equation (10), the following equation (11) is derived:

$$Id=\beta/2\times(Vc(P)\times B(i,j)+Vt(i,j)-Vt)2 \quad (11)$$

When the drive current Id is smaller than a target amount, the drive current Id needs to be increased. To do so, the threshold voltage correction data Vt(i, j) or the mobility correction data B(i, j) may be increased. When the drive current Id is larger than the target amount, the drive current Id needs to be reduced. To do so, the threshold voltage correction data Vt(i, j) or the mobility correction data B(i, j) may be reduced.

Figure 9:
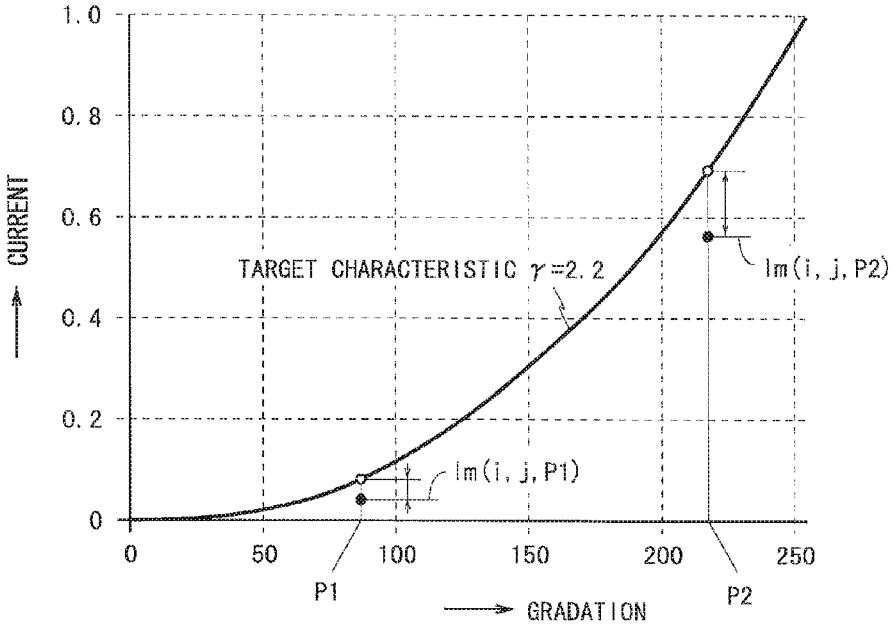
FIG. 9 is a diagram showing a gradation-current characteristic of the display device shown in FIG. 1.

FIG. 9 is a diagram showing a gradation-current characteristic of the display device 10. FIG. 9 describes a characteristic for γ=2.2 as a target characteristic. The CPU 46 updates the threshold voltage correction data Vt(i, j) and the mobility correction data B(i, j) by the above-described method. Hence, the first drive current value Im(i, j, P1) and the second drive current value Im(i, j, P2) ultimately match their respective target values. In other words, a drive current when the first gradation P1 is written to the pixel circuit PX(i, j) and a drive current when the second gradation P2 is written to the pixel circuit PX(i, j) match their respective target amounts. In FIG. 9, two black closed circles match two white open circles, respectively. Hence, a drive current when an arbitrary gradation P is written to the pixel circuit PX (i, j) substantially matches a target amount set for the gradation P. Therefore, according to the display device 10, by correcting the threshold voltage and mobility of the TFT 21 on a per pixel circuit 20 basis, luminance nonuniformity on a display screen is suppressed, enabling to perform high image quality display.

Figure 10:
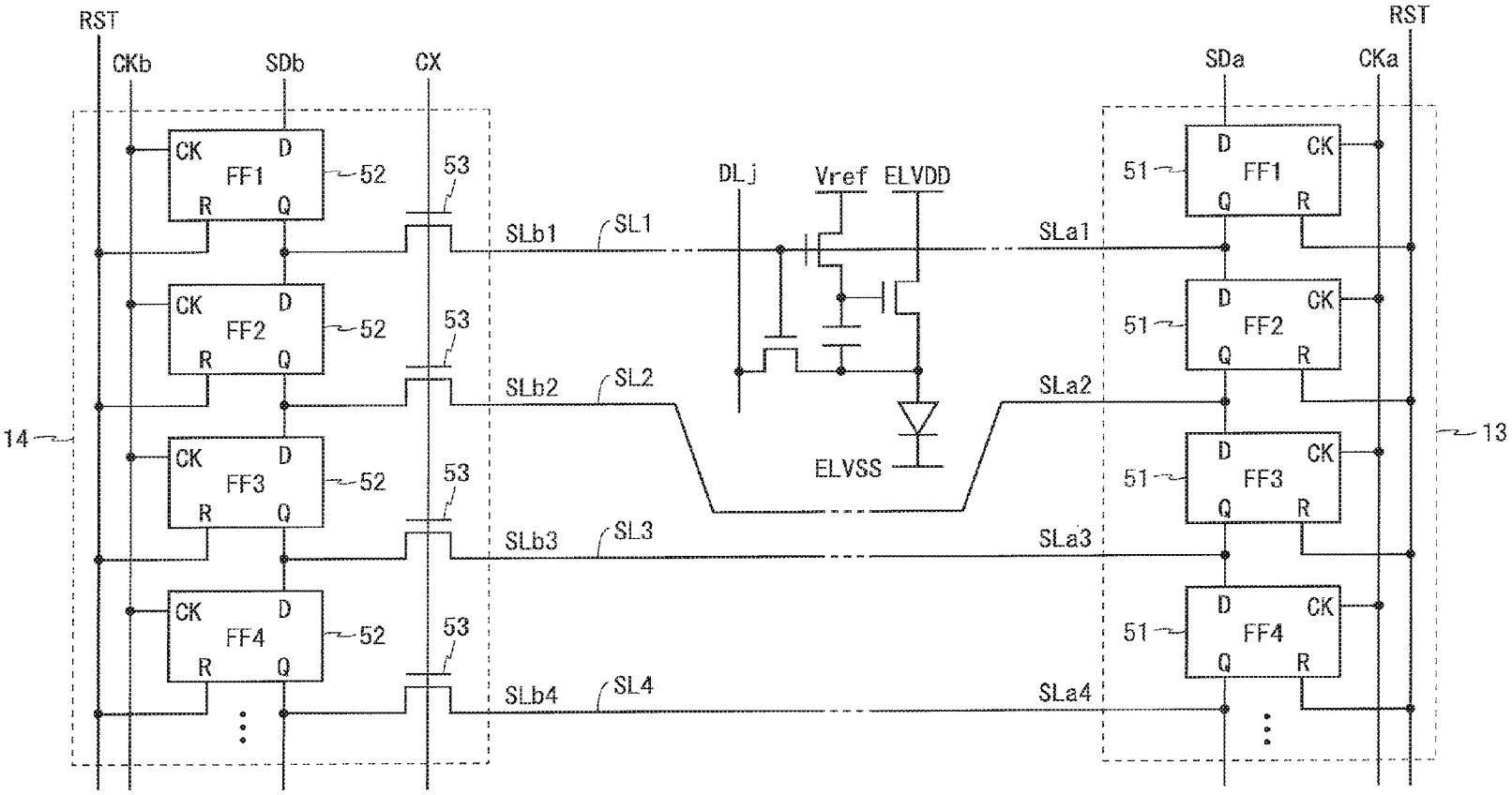
FIG. 10 is a circuit diagram of first and second scanning line drive circuits of the display device shown in FIG. 1.

FIG. 10 is a circuit diagram of the first scanning line drive circuit 13 and the second scanning line drive circuit 14. As shown in FIG. 10, the first scanning line drive circuit 13 includes m flip-flops 51 connected in multiple stages. Each flip-flop 51 has a reset terminal R, a clock terminal CK, an input terminal D, and an output terminal Q. A reset signal RST is supplied to the reset terminals R of the m flip-flops 51, and a clock signal CKa is supplied to the clock terminals CK of the m flip-flops 51. A control signal SDa is supplied to the input terminal D of the flip-flop 51 in the first stage. The input terminals D of the flip-flops 51 in the second and subsequent stages are connected to the output terminals Q of the flip-flops 51 in their preceding stages. The output terminals Q of them flip-flops 51 are connected to the scanning lines SL1 to SLm, respectively.

The second scanning line drive circuit 14 includes m flip-flops 52 connected in multiple stages; and m N-channel transistors 53. The reset signal RST is supplied to reset terminals R of the m flip-flops 52, and a clock signal CKb is supplied to clock terminals CK of the m flip-flops 52. A control signal SDb is supplied to an input terminal D of the flip-flop 52 in the first stage. Input terminals D of the flip-flops 52 in the second and subsequent stages are connected to output terminals Q of the flip-flops 52 in their preceding stages. The m transistors 53 are provided between the output terminals Q of the m flip-flops 52 and the scanning lines SL1 to SLm. A control signal CX included in the control signal C2 is supplied to control terminals of the m transistors 53.

Figure 11:
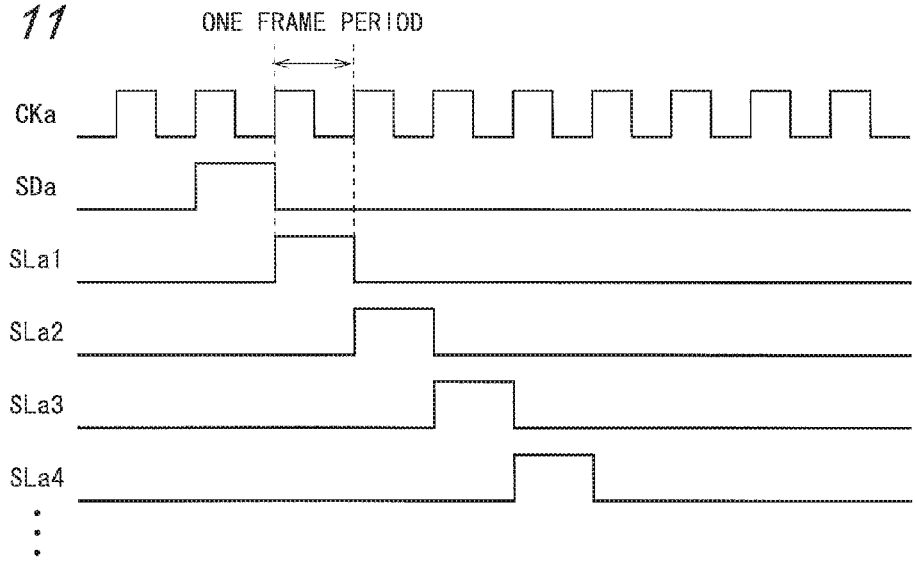
FIG. 11 is a timing chart of the first scanning line drive circuit of the display device shown in FIG. 1.

FIG. 11 is a timing chart of the first scanning line drive circuit 13. As shown in FIG. 11, the clock signal CKa is a clock signal with a cycle of one line period. The control signal SDa goes to the high level over one line period at the beginning of a frame period. During a line period subsequent to the line period where the control signal SDa is at the high level, an output signal SLa1 from the flip-flop 51 in the first stage goes to the high level. During the next line period, an output signal SLa2 from the flip-flop 51 in the second stage goes to the high level. For the subsequent output signals, likewise, output signals SLa3, SLa4, . . . from the flip-flops 51 in the third and subsequent stages go to the high level in turn for one line period. The output signals SLa1 to SLam are applied to the scanning lines SL1 to SLm, respectively.

Figure 12:
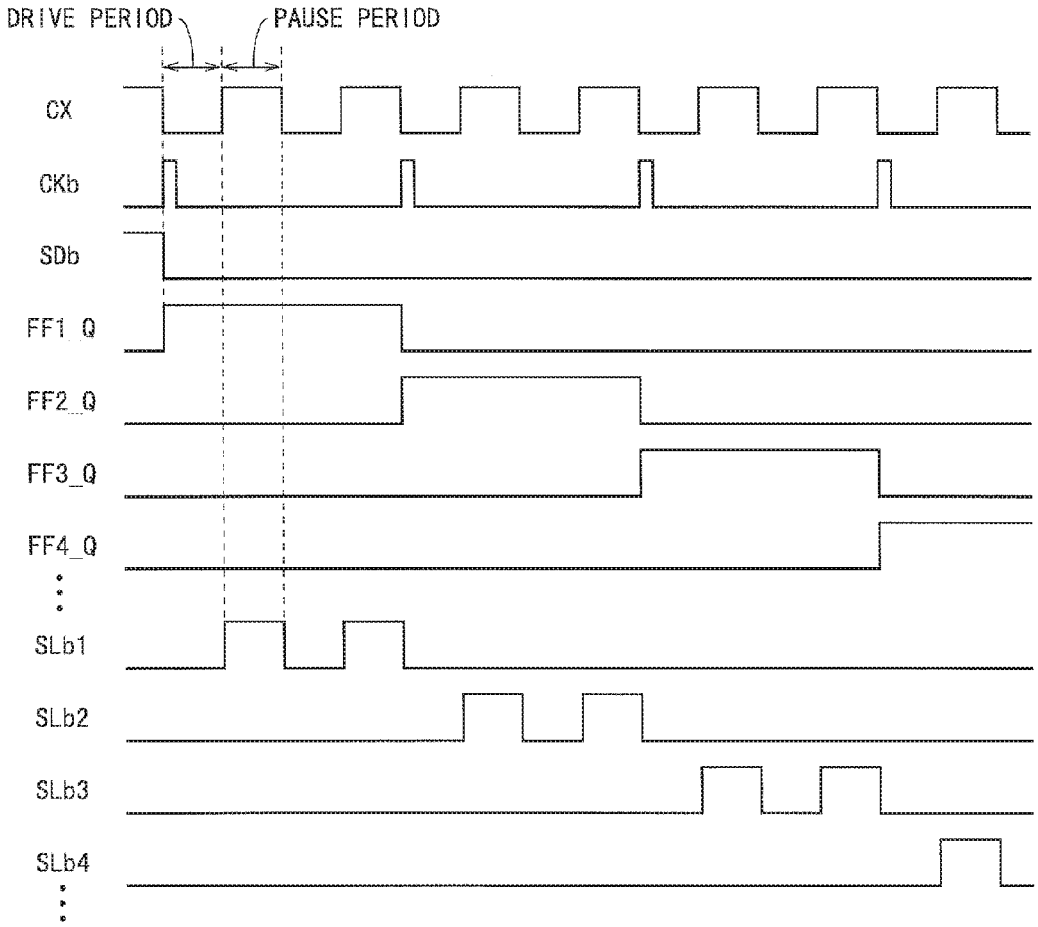
FIG. 12 is a timing chart of the second scanning line drive circuit of the display device shown in FIG. 1.

FIG. 12 is a timing chart of the second scanning line drive circuit 14. As shown in FIG. 12, the control signal CX goes to the low level during the drive period and goes to the high level during the pause period. The clock signal CKb is a clock signal with a cycle of four frame periods, and goes to the high level for a predetermined period of time at the beginning of the drive period. The control signal SDb goes to the high level over four frame periods before the pixel circuits 20 in the first row are set as measurement targets. During four frame periods subsequent to the four frame periods where the control signal SDb is at the high level, an output signal FF1_Q from the flip-flop 52 in the first stage goes to the high level. During the next four frame periods, an output signal FF2_Q from the flip-flop 52 in the second stage goes to the high level. For the subsequent output signals, likewise, output signals FF3_Q, FF4_Q, . . . from the flip-flops 52 in the third and subsequent stages go to the high level in turn for four frame periods.

When the control signal CX is at the high level, the m transistors 53 go to the on state, and the output signals FF1_Q to FFm_Q from the m flip-flops 52 become output signals SLb1 to SLbm from the second scanning line drive circuit 14. When the control signal CX is at the low level, the m transistors 53 go to the off state, and the output signals SLb1 to SLbm from the second scanning line drive circuit 14 go to the low level. As a result, the output signal SLb1 goes to the high level when the output signal from the flip-flop 52 in the first stage and the control signal CX are at the high level. The output signal SLb2 goes to the high level four frame periods after high-level periods of the output signal SLb1. For the subsequent output signals, likewise, an output signal SLbi goes to the high level four frame periods after high-level periods of an output signal SLbi−1.

Figure 13:
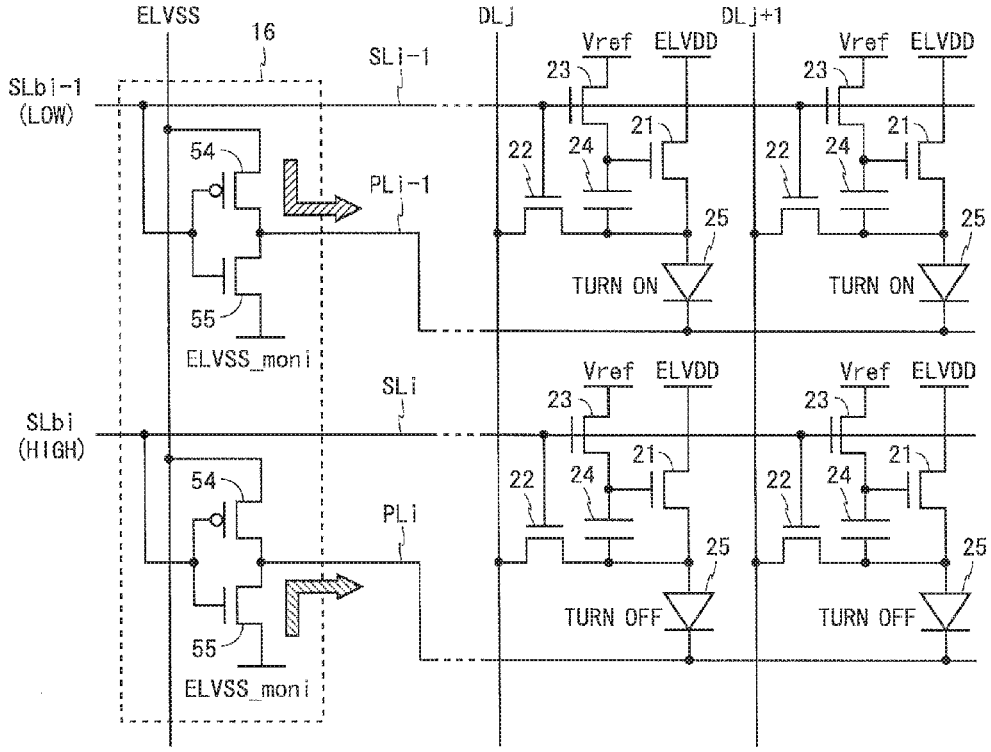
FIG. 13 is a circuit diagram of a power supply voltage selection circuit of the display device shown in FIG. 1.

FIG. 13 is a circuit diagram of the power supply voltage selection circuit 16. As shown in FIG. 13, the power supply voltage selection circuit 16 includes a P-channel transistor 54 and an N-channel transistor 55 corresponding to the power supply line PLi. The first low-level power supply voltage ELVSS is applied to a source terminal of the transistor 54, and the second low-level power supply voltage ELVSS_moni is applied to a source terminal of the transistor 55. Drain terminals of the transistors 54 and 55 are connected to the power supply line PLi. The output signal SLbi from the second scanning line drive circuit 14 is supplied to gate terminals of the transistors 54 and 55. The output signal SLbi goes to the high level during the pause period and when pixel circuits 20 in the i-th row are measurement targets, and goes to the low level otherwise.

Since the output signal SLbi goes to the high level during the pause period and when pixel circuits 20 in the i-th row are measurement targets, the transistor 54 goes to the off state and the transistor 55 goes to the on state. At this time, the second low-level power supply voltage ELVSS_moni is applied through the transistor 55 to the power supply line PLi. At other times, the output signal SLbi goes to the low level and thus the transistor 54 goes to the on state and the transistor 55 goes to the off state. At this time, the first low-level power supply voltage ELVSS is applied through the transistor 54 to the power supply line PLi.

Figure 18:
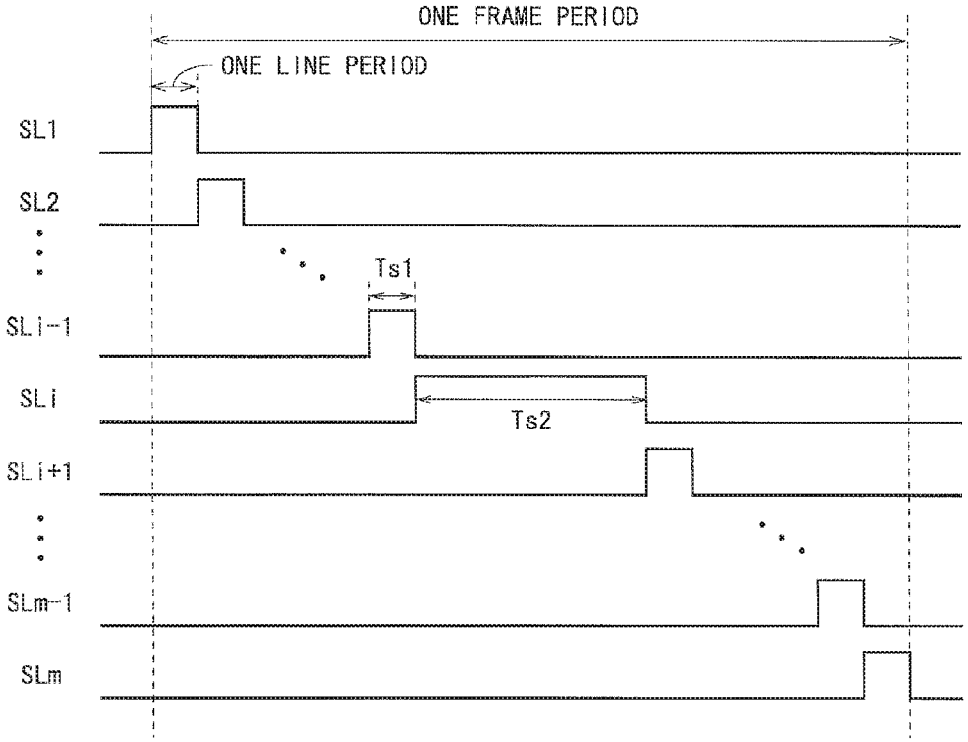
FIG. 18 is a timing chart of a conventional display device.

The effects of the display device 10 according to the present embodiment will be described below. As described above, the display device according to the comparative example (the display device that drives the scanning lines at timing shown in FIG. 18) has problems that the configuration of the scanning line drive circuit becomes complex, luminance nonuniformity on a display screen cannot be sufficiently suppressed, and peak power consumption is high.

On the other hand, the display device 10 according to the present embodiment classifies frame periods as the drive period and the pause period, and measures drive currents during the pause period. The scanning line drive circuit of the display device 10 applies the selection voltage to the scanning lines SL1 to SLm in turn during the drive period, and applies the selection voltage to one scanning line SLi corresponding to measurement target pixel circuits during the pause period (see FIGS. 4 and 5). Such a scanning line drive circuit can be easily formed using the first scanning line drive circuit 13 and the second scanning line drive circuit 14 (see FIG. 10). Therefore, according to the display device 10, the configuration of the scanning line drive circuit can be simplified compared to the display device according to the comparative example.

In addition, since the display device 10 performs measurement of drive currents during the pause period, the display device 10 can secure sufficient time for measurement of drive currents. In the longest case, measurement of drive currents may be performed over one frame period. The longer the drive current measurement time, the more accurately the drive currents can be measured. Thus, the characteristics (threshold voltage and mobility) of the TFTs 21 can be more effectively compensated for. Accordingly, the display device 10 can effectively compensate for variations in the characteristics of the TFTs 21 and thus can effectively suppress luminance nonuniformity on a display screen, compared to the display device according to the comparative example.

In addition, the display device 10 performs a write of voltages and a measurement of drive currents during different frame periods. Therefore, the display device 10 can reduce peak power consumption compared to the display device according to the comparative example.

As described above, the display device 10 according to the present embodiment includes the (m×n) pixel circuits 20; the drive circuit (the first scanning line drive circuit 13, the second scanning line drive circuit 14, and the data line drive/current measurement circuit 15) that writes voltages to the pixel circuits 20; the measurement circuit (the data line drive/current measurement circuit 15) that measures drive currents outputted from the pixel circuits 20; and the correction circuit (the correction calculation circuit 18) that corrects a video signal based on the drive currents measured by the measurement circuit. The drive circuit classifies frame periods as a drive period and a pause period, and applies a selection voltage to the scanning lines SL1 to SLm in turn and applies voltages (data voltages, first measurement voltages, or second measurement voltages) to be written to the pixel circuits 20 to the data lines DL1 to DLn in turn during the drive period, and applies the selection voltage to one scanning line SLi corresponding to measurement target pixel circuits 20 during the pause period. The measurement circuit measures drive currents outputted from the measurement target pixel circuits 20, during the pause period. Therefore, the display device 10 can, as described above, simplify the configuration of the scanning line drive circuit, effectively suppress luminance nonuniformity on a display screen, and reduce peak power consumption.

In addition, the drive circuit applies voltages according to a corrected video signal D2 to the data lines DL1 to DLn during a selection period of a scanning line corresponding to pixel circuits 20 which are not measurement targets, in the drive period, and applies first or second measurement voltages to the data lines DL1 to DLn during a selection period of the scanning line SLi corresponding to the measurement target pixel circuits 20, in the drive period. By thus writing the measurement voltage to the measurement target pixel circuits during the drive period, drive currents outputted from the pixel circuits to which the measurement voltage has been written can be measured during the subsequent pause period.

In addition, the drive circuit classifies four frame periods as a first drive period, a first pause period, a second drive period, and a second pause period in this order, and applies a first measurement voltage to a data line DLj during a selection period of a scanning line SLi corresponding to measurement target pixel circuits 20 in the first drive period, and applies a second measurement voltage to the data line DLj during a selection period of the scanning line SLi corresponding to the measurement target pixel circuits 20 in the second drive period. The measurement circuit measures drive currents outputted from the measurement target pixel circuits 20 as a first drive current during the first pause period, and measures drive currents outputted form the measurement target pixel circuits 20 as a second drive current during the second pause period. The correction circuit corrects a portion of a video signal D1 corresponding to the measurement target pixel circuits 20, based on the first and second drive currents. By thus performing each of a write of a measurement voltage and a measurement of a drive current twice on a measurement target pixel circuit during four frame periods, and correcting a video signal based on two measurement results, variations in two types of characteristics (threshold voltage and mobility) of a drive transistor can be compensated for, enabling to effectively suppress luminance nonuniformity on a display screen.

In addition, the drive circuit applies the selection voltage to one scanning line SLi corresponding to measurement target pixel circuits 20 during one pause period. By this, during one pause period, variations in the characteristics of drive transistors in a plurality of pixel circuits connected to one scanning line can be compensated for.

In addition, the display device 10 includes a storage unit (the correction data storage unit 19) that stores, for each pixel circuit 20, pieces of first and second correction data (threshold voltage correction data and mobility correction data) which are used to correct the video signal. The correction circuit corrects first correction data for the measurement target pixel circuits 20 based on the first drive current, updates second correction data for the measurement target pixel circuits 20 based on the second drive current, and corrects a portion of a video signal D1 corresponding to the measurement target pixel circuits 20 based on the first and second correction data. By thus storing, for each pixel circuit, two pieces of correction data, updating the two pieces of correction data based on two measurement results, and correcting a video signal based on the two pieces of correction data, variations in two types of characteristics of the drive transistor can be compensated for, enabling to effectively suppress luminance nonuniformity on a display screen.

In addition, the drive circuit includes the first scanning line drive circuit 13 that drives the scanning lines SL1 to SLm during the drive period; and the second scanning line drive circuit 14 that drives the scanning lines SL1 to SLm during the pause period. By thus dividing the circuit into a circuit that operates during the drive period and a circuit that operates during the pause period, the scanning line drive circuit can be easily formed.

In addition, the drive circuit and the measurement circuit share a drive/measurement circuit (the operational amplifier 32, the capacitor 33, and the switch 34) provided corresponding to the data line DLj. By using the drive/measurement circuits, the drive circuit that writes voltages to the pixel circuits and the measurement circuit that measures drive currents outputted to the data lines from the pixel circuits can be easily formed.

Second Embodiment

A display device according to a second embodiment of the present invention has the same configuration as the display device 10 according to the first embodiment (see FIG. 1). The display device according to the first embodiment measures a first drive current during a first pause period F2, and measures a second drive current during a second pause period F4. On the other hand, the display device according to the present embodiment measures the first drive current and the second drive current during one pause period. Differences from the first embodiment will be described below.

The display device according to the present embodiment writes display data voltages to all pixel circuits 20 during a drive period. More specifically, during the drive period, a second scanning line drive circuit 14 stops its operation. A first scanning line drive circuit 13 selects scanning lines SL1 to SLm in turn for one line period, and applies a selection voltage to the selected scanning line (see FIG. 4). A data line drive/current measurement circuit 15 applies n data voltages based on a corrected video signal D2, to data lines DL1 to DLn, respectively.

Figure 14:
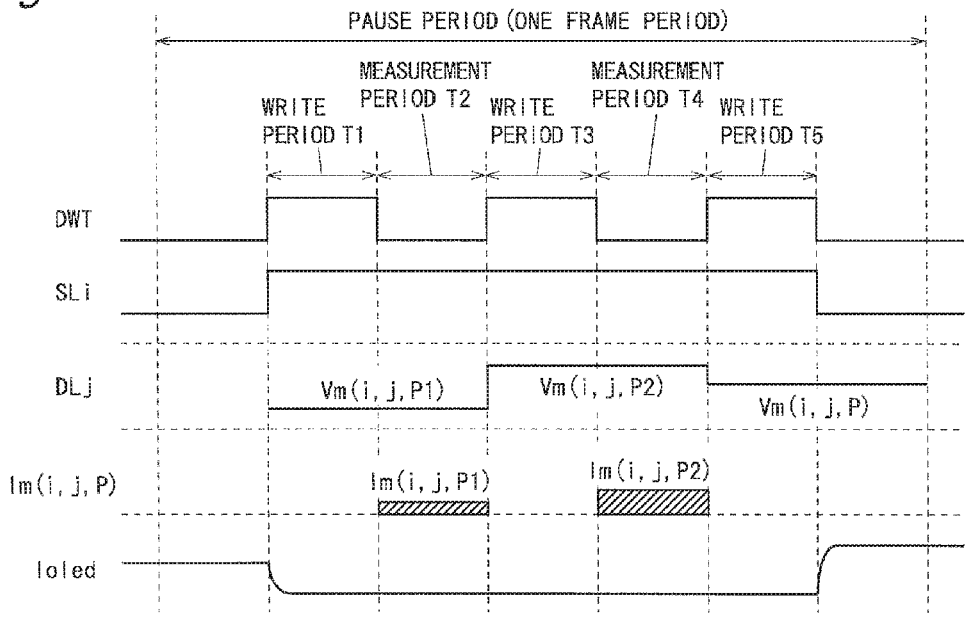
FIG. 14 is a timing chart of a pause period of a display device according to a second embodiment of the present invention.

FIG. 14 is a timing chart of a pause period of the display device according to the present embodiment. As shown in FIG. 14, a drive circuit of the display device according to the present embodiment sets, in one pause period, a first write period T1, a first measurement period T2, a second write period T3, a second measurement period T4, and a third write period T5 in this order. When pixel circuits 20 in an i-th row are measurement targets, the second scanning line drive circuit 14 applies the selection voltage to a scanning line SLi during the periods T1 to T5. Note that in each of the pixel circuits 20 in the i-th row, a current Ioled flowing through an organic EL element 25 is zero during the periods T1 to T5.

Voltage write operation and current measurement operation for a pixel circuit PX(i, j) will be described below. During the first to third write periods T1, T3, and T5, an input/output control signal DWT goes to a high level, and the data line drive/current measurement circuit 15 functions as a data line drive circuit. During the first and second measurement periods T2 and T4, the input/output control signal DWT goes to a low level, and the data line drive/current measurement circuit 15 functions as a current measurement circuit.

During the first write period T1, the data line drive/current measurement circuit 15 applies a first measurement voltage Vm(i, j, P1) to a data line DLj. The first measurement voltage Vm(i, j, P1) is written to the pixel circuit PX(i, j). During the first measurement period T2, the data line drive/current measurement circuit 15 measures a first drive current Im(i, j, P1) outputted to the data line DLj from the pixel circuit PX (i, j). A CPU 46 updates threshold voltage correction data Vt(i, j) stored in a threshold voltage correction data storage unit 47, based on a first drive current value Im (i, j, P1) obtained at this time.

During the second write period T3, the data line drive/current measurement circuit 15 applies a second measurement voltage Vm(i, j, P2) to the data line DLj. The second measurement voltage Vm(i, j, P2) is written to the pixel circuit PX(i, j). During the second measurement period T4, the data line drive/current measurement circuit 15 measures a second drive current Im(i, j, P2) outputted to the data line DLj from the pixel circuit PX(i, j). The CPU 46 updates mobility correction data B(i, j) stored in a mobility correction data storage unit 48, based on a second drive current value Im(i, j, P2) obtained at this time.

During the third write period T5, the data line drive/current measurement circuit 15 applies a data voltage Vm(i, j, P) to the data line DLj. The data voltage Vm(i, j, P) is written to the pixel circuit PX(i, j). Note that the data voltage Vm(i, j, P) applied during the third write period T5 is a voltage based on the corrected video signal D2 which is obtained by updating the two types of correction data stored in a correction data storage unit 19, based on the first drive current value Im(i, j, P1) and the second drive current value Im(i, j, P2), and referring to the updated correction data.

As in the first embodiment, the display device according to the present embodiment classifies frame periods as a drive period and a pause period, and measures drive currents during the pause period. Therefore, as in the first embodiment, the display device according to the present embodiment can simplify the configuration of the scanning line drive circuit, effectively suppress luminance nonuniformity on a display screen, and reduce peak power consumption.

In addition, in the display device according to the present embodiment, the drive circuit applies voltages according to the corrected video signal D2 to the data lines DL1 to DLn during a selection period of each scanning line in the drive period, sets a write period and a measurement period in the pause period, and applies the first or second measurement voltages to the data lines DL1 to DLn during the write period. The measurement circuit measures drive currents outputted from measurement target pixel circuits 20 during the measurement period. By thus writing the measurement voltage to the measurement target pixel circuits during the write period in the pause period, drive currents outputted from the pixel circuits to which the measurement voltage has been written can be measured during the subsequent measurement period.

In addition, the drive circuit sets, in the pause period, a first write period, a first measurement period, a second write period, and a second pause period in this order, applies a first measurement voltage to a data line DLj during the first write period, and applies a second measurement voltage to the data line DLj during the second write period. The measurement circuit measures drive currents outputted from the measurement target pixel circuits 20 as a first drive current during the first measurement period, and measures drive currents outputted from the measurement target pixel circuits 20 as a second drive current during the second measurement period. A correction circuit corrects a portion of a video signal D1 corresponding to the measurement target pixel circuits 20, based on the first and second drive currents. By thus performing each of a write of a measurement voltage and a measurement of a drive current twice on the measurement target pixel circuit during one frame period, and correcting the video signal based on two measurement results, variations in two types of characteristics (threshold voltage and mobility) of the drive transistor can be compensated for, enabling to effectively suppress luminance nonuniformity on a display screen.

In addition, the drive circuit sets a third write period after the second measurement period in the pause period, and applies voltages according to the corrected video signal D2 to the data lines DL1 to DLn during the third write period. By thus writing, during the third write period, voltages according to the video signal which is corrected based on measurement results obtained during the first and second measurement periods, to the measurement target pixel circuits, results of compensating for variations in the characteristics of a drive transistor can be immediately reflected in a display image.

Third Embodiment

A display device according to a third embodiment of the present invention has the same configuration as the display device 10 according to the first embodiment (see FIG. 1). The display device according to the first embodiment alternately switches between a drive period and a pause period. On the other hand, the display device according to the present embodiment treats a series of pause periods as a consecutive pause period, and alternately switches between the drive period and the consecutive pause period. Differences from the first and second embodiments will be described below.

Figure 15:
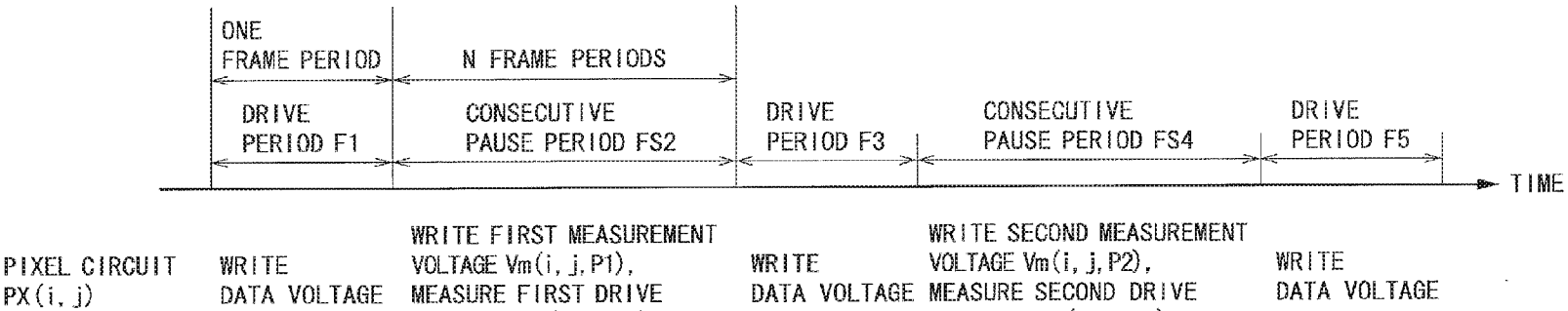
FIG. 15 is a diagram showing the operation of a display device according to a third embodiment of the present invention which is performed during drive periods and consecutive pause periods.

FIG. 15 is a diagram showing the operation of the display device according to the present embodiment performed during drive periods and consecutive pause periods. As shown in FIG. 15, a drive circuit of the display device according to the present embodiment classifies a plurality of frame periods as a first drive period F1, a first consecutive pause period FS2, a second drive period F3, a second consecutive pause period FS4, and a third drive period F5 in this order. Each of the first and second consecutive pause periods FS2 and FS4 consists of N pause periods (N is an integer greater than or equal to 2). The display device according to the present embodiment performs the same operation on all pixel circuits 20 during the periods F1, FS2, F3, FS4, and F5.

During the first drive period F1, the display device according to the present embodiment writes a display data voltage to a pixel circuit PX(i, j). During the first consecutive pause period FS2, the display device according to the present embodiment writes a first measurement voltage Vm(i, j, P1) to the pixel circuit PX(i, j), and measures a first drive current Im(i, j, P1) outputted from the pixel circuit PX(i, j). During the second drive period F3, the display device according to the present embodiment writes a display data voltage to the pixel circuit PX(i, j). During the second consecutive pause period FS4, the display device according to the present embodiment writes a second measurement voltage Vm(i, j, P2) to the pixel circuit PX(i, j), and measures a second drive current Im(i, j, P2) outputted from the pixel circuit PX(i, j). During the third drive period F5, the display device according to the present embodiment writes a display data voltage to the pixel circuit PX(i, j).

Figure 16:
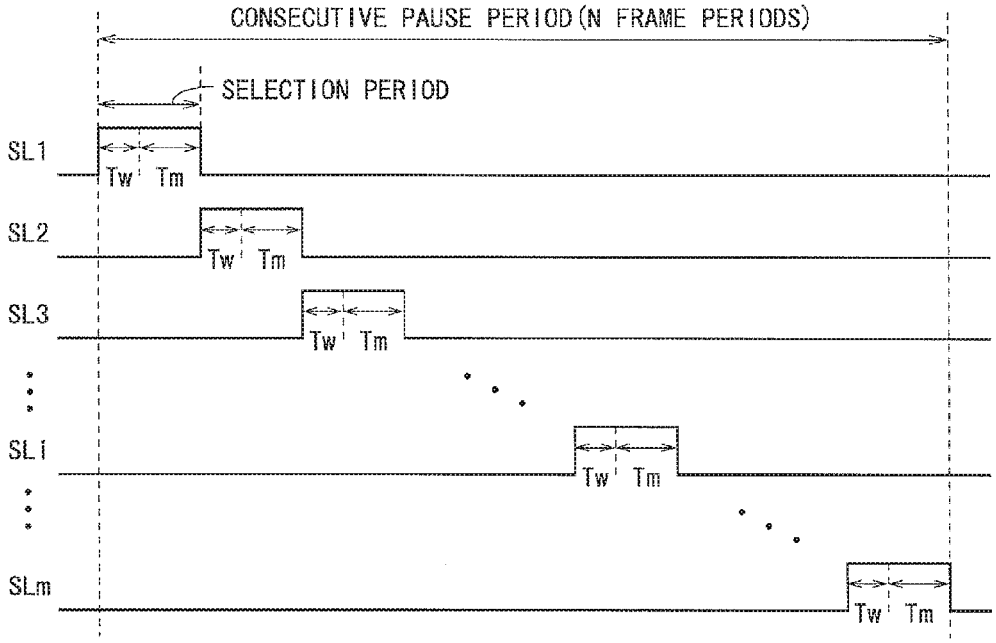
FIG. 16 is a timing chart of a consecutive pause period of the display device according to the third embodiment of the present invention.

As in the second embodiment, the display device according to the present embodiment writes display data voltages to all of the pixel circuits 20 during the drive period. FIG. 16 is a timing chart of the consecutive pause period of the display device according to the present embodiment. As shown in FIG. 16, a drive circuit of the display device according to the present embodiment sets m selection periods in one consecutive pause period, and sets a write period Tw and a measurement period Tm in each selection period. A second scanning line drive circuit 14 applies a selection voltage to a scanning line SLi during an i-th selection period in the consecutive pause period.

Voltage write operation and current measurement operation for the pixel circuit PX (i, j) will be described below. During the first to third drive periods F1, F3, and F5 and each write period Tw in the first and second consecutive pause periods FS2 and FS4, an input/output control signal DWT goes to a high level, and a data line drive/current measurement circuit 15 functions as a data line drive circuit. During each measurement period Tm in the first and second consecutive pause periods FS2 and FS4, the input/output control signal DWT goes to a low level, and the data line drive/current measurement circuit 15 functions as a current measurement circuit.

During a selection period of a scanning line SLi in the first drive period F1, the data line drive/current measurement circuit 15 applies a display data voltage Vm(i, j, P) to a data line DLj. The data voltage Vm(i, j, P) is written to the pixel circuit PX(i, j).

During a write period Tw in a selection period of the scanning line SLi in the first consecutive pause period FS2, the data line drive/current measurement circuit 15 applies the first measurement voltage Vm(i, j, P1) to the data line DLj. The first measurement voltage Vm(i, j, P1) is written to the pixel circuit PX(i, j). During a measurement period Tm immediately thereafter, the data line drive/current measurement circuit 15 measures the first drive current Im(i, j, P1) outputted to the data line DLj from the pixel circuit PX (i, j). A CPU 46 updates threshold voltage correction data Vt(i, j) stored in a threshold voltage correction data storage unit 47, based on the first drive current value Im(i, j, P1) obtained at this time.

During a selection period of the scanning line SLi in the second drive period F3, the data line drive/current measurement circuit 15 applies a display data voltage Vm(i, j, P) to the data line DLj. The data voltage Vm(i, j, P) is written to the pixel circuit PX(i, j).

During a write period Tw in a selection period of the scanning line SLi in the second consecutive pause period FS4, the data line drive/current measurement circuit 15 applies the second measurement voltage Vm(i, j, P2) to the data line DLj. The second measurement voltage Vm(i, j, P2) is written to the pixel circuit PX(i, j). During a measurement period Tm immediately thereafter, the data line drive/current measurement circuit 15 measures the second drive current Im (i, j, P2) outputted to the data line DLj from the pixel circuit PX(i, j). The CPU 46 updates mobility correction data B(i, j) stored in a mobility correction data storage unit 48, based on the second drive current value Im(i, j, P2) obtained at this time.

During a selection period of the scanning line SLi in the third drive period F5, the data line drive/current measurement circuit 15 applies the display data voltage Vm(i, j, P) to the data line DLj. The data voltage Vm(i, j, P) is written to the pixel circuit PX(i, j). Note that the data voltage Vm(i, j, P) applied during the third drive period F5 is a voltage based on the corrected video signal D2 which is obtained by updating the two types of correction data stored in a correction data storage unit 19, based on the first drive current value Im(i, j, P1) and the second drive current value Im(i, j, P2), and referring to the updated correction data.

As in the first and second embodiments, the display device according to the present embodiment classifies frame periods as a drive period and a pause period, and measures drive currents during the pause period. Therefore, as in the first and second embodiments, the display device according to the present embodiment can simplify the configuration of the scanning line drive circuit, effectively suppress luminance nonuniformity on a display screen, and reduce peak power consumption.

In addition, in the display device according to the present embodiment, the drive circuit applies voltages according to the corrected video signal D2 to data lines DL1 to DLn during a selection period of each scanning line in the drive period, and during a consecutive pause period, applies a selection voltage to scanning lines SL1 to SLm in turn, sets a write period and a measurement period in a selection period of each scanning line, and applies the first or second measurement voltage to the data line DLj during each write period. The measurement circuit measures drive currents outputted from the measurement target pixel circuits 20 during each measurement period. By thus writing a measurement voltage to the measurement target pixel circuits during each write period in the consecutive pause period, drive currents outputted from the pixel circuits to which the measurement voltage has been written can be measured during the subsequent measurement period.

In addition, the drive circuit applies the selection voltage to all of the scanning lines SL1 to SLm in turn during one consecutive pause period. By this, during one consecutive pause period, variations in the characteristics of drive transistors in all pixel circuits can be compensated for.

In addition, the drive circuit applies the first measurement voltage to the data line DLj during each write period in the first consecutive pause period, and applies the second measurement voltage to the data line DLj during each write period in the second consecutive pause period. The measurement circuit measures drive currents outputted from the measurement target pixel circuits 20 as a first drive current during each measurement period in the first consecutive pause period, and measures drive currents outputted from the measurement target pixel circuits 20 as a second drive current during each measurement period in the second consecutive pause period. A correction circuit corrects a portion of the video signal D1 corresponding to the measurement target pixel circuits, based on the first and second drive currents. By thus performing each of a write of a measurement voltage and a measurement of drive current twice on all pixel circuits during two consecutive pause periods, and correcting the video signal based on two measurement results, variations in two types of characteristics (threshold voltage and mobility) of the drive transistors can be compensated for, enabling to effectively suppress luminance nonuniformity on a display screen.

Figure 17:
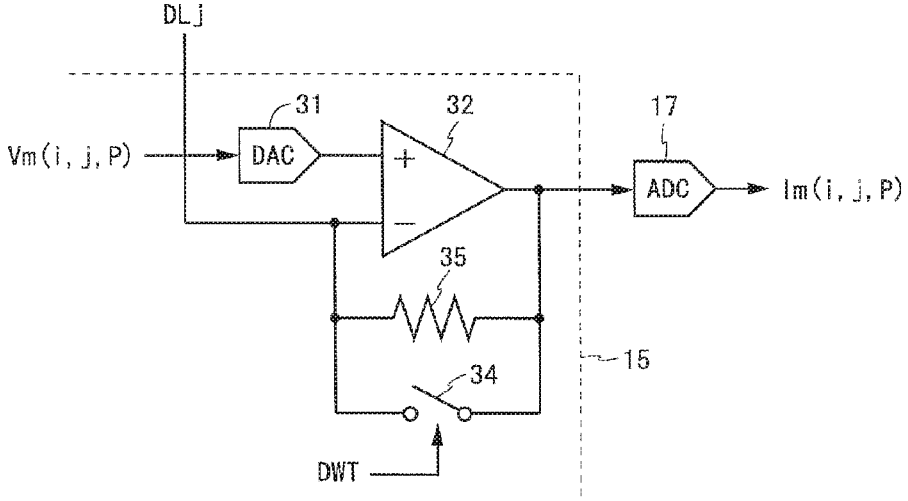
FIG. 17 is a circuit diagram showing apart of a data line drive/current measurement circuit of a display device according to a variant of the present invention.

Note that concerning the display devices according to the embodiments of the present invention, the following variants can be formed. Although the pixel circuit 20 shown in FIG. 2 includes N-channel TFTs 21 to 23, the pixel circuit 20 may include P-channel TFTs. In the case of forming the pixel circuit 20 using P-channel TFTs, polarities of voltages provided to the pixel circuit 20 and polarities of voltages in the pixel circuit 20 are reversed. In addition, although the data line drive/current measurement circuit 15 shown in FIG. 2 includes the capacitor 33 between the inverting input terminal and output terminal of the operational amplifier 32 and in parallel to the switch 34, the data line drive/current measurement circuit 15 may include a resistor 35 in place of the capacitor 33 (see FIG. 17). When the switch 34 is in an off state, the operational amplifier 32 and the resistor 35 function as an integrating circuit. As such, either one of a capacitive element and a resistive element may be provided as a passive element between the inverting input terminal and output terminal of the operational amplifier.

In addition, in the display devices according to the first and second embodiments, during one pause period, the drive circuit may apply, in turn, a selection voltage to a plurality of scanning lines corresponding to measurement target pixel circuits. By this, during one pause period, variations in the characteristics of drive transistors in a plurality of pixel circuits connected to a plurality of scanning lines can be compensated for. In addition, in the display device according to the third embodiment, the drive circuit may apply the selection voltage to some of the scanning lines SL1 to SLm in turn during one consecutive pause period.

In addition, the classifications of frame periods shown in FIGS. 3 and 15 are examples of a classification method, and the setting of write periods and measurement periods in a pause period which is shown in FIG. 14 is an example of a setting method. The drive circuit of the display device according to the first embodiment may classify frame periods as a drive period and a pause period in other manners than that shown in FIG. 3. The drive circuit of the display device according to the second embodiment may set write periods and measurement periods in a pause period in other manners than that shown in FIG. 14. The drive circuit of the display device according to the third embodiment may classify frame periods as a drive period and a consecutive pause period in other manners than that shown in FIG. 15.

INDUSTRIAL APPLICABILITY

Display devices and methods for driving the display devices of the present invention are characterized by having a scanning line drive circuit with a simple configuration, being capable of effectively suppressing luminance nonuniformity, and having low power consumption, and thus can be used, for example, for display devices having current-driven type light-emitting elements such as organic EL elements.

DESCRIPTION OF REFERENCE CHARACTERS

10: DISPLAY DEVICE
11: DISPLAY UNIT
12: DISPLAY CONTROL CIRCUIT
13: FIRST SCANNING LINE DRIVE CIRCUIT
14: SECOND SCANNING LINE DRIVE CIRCUIT
15: DATA LINE DRIVE/CURRENT MEASUREMENT CIRCUIT
16: POWER SUPPLY VOLTAGE SELECTION CIRCUIT
17: A/D CONVERTER
18: CORRECTION CALCULATION CIRCUIT
19: CORRECTION DATA STORAGE UNIT
20: PIXEL CIRCUIT
21, 22, and 23: TFT
24 and 33: CAPACITOR
25: ORGANIC EL ELEMENT
31: D/A CONVERTER
32: OPERATIONAL AMPLIFIER
34: SWITCH
35: RESISTOR
47: THRESHOLD VOLTAGE CORRECTION DATA STORAGE UNIT
48: MOBILITY CORRECTION DATA STORAGE UNIT

The invention claimed is:

1. A display device having current-driven type light-emitting elements, the display device comprising:

a plurality of pixel circuits arranged corresponding to intersections of a plurality of scanning lines and a plurality of data lines;

a drive circuit configured to write voltages to the pixel circuits by driving the scanning lines and the data lines;

a measurement circuit configured to measure outputs from the pixel circuits via the data lines; and a correction circuit configured to correct a video signal based on the outputs measured by the measurement circuit, wherein each of the pixel circuits includes:

a light-emitting element; and a drive transistor configured to output a drive current to the light-emitting element, the drive circuit is configured to classify frame periods as a drive period and a pause period, to apply a selection voltage to the scanning lines in turn and apply voltages to be written to the pixel circuits to the data lines in turn during the drive period, and to apply the selection voltage to one or more scanning lines corresponding to measurement target pixel circuits during the pause period, and the measurement circuit is configured to measure the outputs from the measurement target pixel circuits during the pause period.

2. The display device according to claim 1, wherein the output is the drive current.

3. The display device according to claim 2, wherein the drive circuit is configured to apply voltages according to a corrected video signal to the data lines during a selection period of a scanning line corresponding to pixel circuits that are not measurement targets, in the drive period, and to apply a measurement voltage to the data lines during a selection period of a scanning line corresponding to the measurement target pixel circuits, in the drive period.

4. The display device according to claim 3, wherein the drive circuit is configured to classify four frame periods as a first drive period, a first pause period, a second drive period, and a second pause period in this order, to apply a first measurement voltage to the data lines during the selection period of the scanning line corresponding to the measurement target pixel circuits in the first drive period, and to apply a second measurement voltage to the data lines during the selection period of the scanning line corresponding to the measurement target pixel circuits in the second drive period, the measurement circuit is configured to measure drive currents outputted from the measurement target pixel circuits as a first drive current during the first pause period, and to measure drive currents outputted from the measurement target pixel circuits as a second drive current during the second pause period, and the correction circuit is configured to correct a portion of the video signal corresponding to the measurement target pixel circuits, based on the first and second drive currents.

5. The display device according to claim 2, wherein the drive circuit is configured to apply voltages according to a corrected video signal to the data lines during a selection period of each scanning line in the drive period, to set a write period and a measurement period in the pause period, and to apply a measurement voltage to the data lines during the write period, and the measurement circuit is configured to measure drive currents outputted from the measurement target pixel circuits during the measurement period.

6. The display device according to claim 5, wherein the drive circuit is configured to set a first write period, a first measurement period, a second write period, and a second pause period in this order in the pause period, to apply a first measurement voltage to the data lines during the first write period, and to apply a second measurement voltage to the data lines during the second write period, the measurement circuit is configured to measure drive currents outputted from the measurement target pixel circuits as a first drive current during the first measurement period, and to measure drive currents outputted from the measurement target pixel circuits as a second drive current during the second measurement period, and the correction circuit is configured to correct a portion of the video signal corresponding to the measurement target pixel circuits, based on the first and second drive currents.

7. The display device according to claim 6, wherein the drive circuit is configured to set a third write period after the second measurement period in the pause period, and to apply voltages according to the corrected video signal to the data lines during the third write period.

8. The display device according to claim 3, wherein the drive circuit is configured to apply the selection voltage to one scanning line corresponding to the measurement target pixel circuits during one pause period.

9. The display device according to claim 3, wherein the drive circuit is configured to apply the selection voltage to a plurality of scanning lines in turn during one pause period, the plurality of scanning lines being corresponding to the measurement target pixel circuits.

10. The display device according to claim 2, wherein the drive circuit is configured to apply voltages according to a corrected video signal to the data lines during a selection period of each scanning line in the drive period, and during a consecutive pause period consisting of a series of the pause periods, to apply the selection voltage to the scanning lines in turn, set a write period and a measurement period in a selection period of each scanning line, and apply a measurement voltage to the data lines during each write period, the measurement circuit is configured to measure drive currents outputted from the measurement target pixel circuits during each measurement period, the drive circuit is configured to apply the selection voltage to all of the scanning lines in turn during one consecutive pause period, the drive circuit is configured to apply a first measurement voltage to the data lines during each write period in a first consecutive pause period, and to apply a second measurement voltage to the data lines during each write period in a second consecutive pause period, the measurement circuit is configured to measure drive currents outputted from the measurement target pixel circuits as a first drive current during each measurement period in the first consecutive pause period, and to measure drive currents outputted from the measurement target pixel circuits as a second drive current during each measurement period in the second consecutive pause period, and the correction circuit is configured to correct a portion of the video signal corresponding to the measurement target circuits, based on the first and second drive currents.

11. The display device according to claim 4, further comprising a storage unit configured to store, for each of the pixel circuits, first and second correction data to be used to correct the video signal, wherein the correction circuit is configured to update first correction data for the measurement target pixel circuits based on the first drive current, to update second correction data for the measurement target pixel circuits based on the second drive current, and to correct a portion of the video signal corresponding to the measurement target pixel circuits, based on the first and second correction data.

12. The display device according to claim 2, wherein the drive circuit includes a first scanning line drive circuit configured to drive the scanning lines during the drive period; and a second scanning line drive circuit configured to drive the scanning lines during the pause period.

13. The display device according to claim 2, wherein the drive circuit and the measurement circuit are configured to share drive/measurement circuits corresponding to the data lines, each of the drive/measurement circuits includes an operational amplifier having an inverting input terminal connected to a corresponding one of the data lines; a switching element provided between the inverting input terminal and an output terminal of the operational amplifier; and a passive element provided between the inverting input terminal and output terminal of the operational amplifier and in parallel to the switching element, and the passive element is either one of a capacitive element and a resistive element.

14. The display device according to claim 1, wherein the drive circuit includes a data line drive circuit configured to drive the data lines based on the video signal, the correction circuit and the data line drive circuit share the data lines, the data lines are electrically connected to one of the correction circuit and the data line drive circuit by a switch, in the drive period, the data lines are electrically connected to the data line drive circuit by the switch, and in the pause period, the data lines are electrically connected to the correction circuit by the switch.

15. The display device according to claim 14, wherein the light-emitting element is electrically connected to a power supply line, and the power supply line is configured to supply a second low-level power supply voltage to the measurement target pixel circuits and supply a first low-level power supply voltage to other pixel circuits.

16. The display device according to claim 15, wherein when a source voltage of the drive transistor is Vs and a light-emission threshold voltage of the light-emitting element is Vt_oled, the second low-level power supply voltage ELVSS_moni satisfies the following equation (A):

$$|Vs-\text{ELVSS_moni}|<|Vt_\text{oled}| \quad \text{(A)}.$$

17. The display device according to claim 15, wherein the output is the drive current, and the drive current does not flow through the light-emitting element and flows through the measurement circuit via the drive transistor and the data line.

18. The display device according to claim 15, wherein for a threshold voltage correction data Vt(i,j), a first drive current value Im(i,j,P1), a first target current value I(P1), an amount of update ΔV, and a dead zone width V_dz, the correction circuit is configured to add ΔV to the threshold voltage correction data Vt(i,j) when the following equation (B1) holds, to subtract ΔV from the threshold voltage correction data Vt(i,j) when the following equation (B2) holds, and not to update the threshold voltage correction data Vt(i,j) when the following equation (B3) holds:

$$I(P1)-Im(i,j,P1)>V_dz \quad \text{(B1)}$$

$$I(P1)-Im(i,j,P1)<-V_dz \quad \text{(B2)}$$

$$|I(P1)-Im(i,j,P1)|<=V_dz \quad \text{(B3), and}$$

the first drive current value Im(i,j,P1) approaches the first target current value I(P1) in a stepwise manner and ultimately converges to the first target current value I(P1).

19. The display device according to claim 15, wherein for a mobility correction data B(i,j), a second drive current value Im(i,j,P2), a second target current value I(P2), an amount of update ΔB, and a dead zone width B_dz, the correction circuit is configured to add ΔB to the mobility correction data B(i,j) when the following equation (C1) holds, to subtract ΔB from the mobility correction data B(i,j) when the following equation (C2) holds, and not to update the mobility correction data B(i,j) when the following equation (C3) holds:

$$I(P2)-Im(i,j,P2)>B_dz \quad \text{(C1)}$$

$$I(P2)-Im(i,j,P2)<-B_dz \quad \text{(C2)}$$

$$|I(P2)-Im(i,j,P2)|<=B_dz \quad \text{(C3), and}$$

the second drive current value Im(i,j,P2) approaches the second target current value I(P2) in a stepwise manner and ultimately converges to the second target current value I(P2).

20. A method for driving a display device including a plurality of pixel circuits arranged corresponding to intersections of a plurality of scanning lines and a plurality of data lines, each of the pixel circuits including a current-driven type light-emitting element; and a drive transistor configured to output a drive current to the light-emitting element, the method comprising:

a driving step of writing voltages to the pixel circuits by driving the scanning lines and the data lines;

a measuring step of measuring outputs from the pixel circuits via the data lines; and a correcting step of correcting a video signal based on the measured outputs, wherein in the driving step, frame periods are classified as a drive period and a pause period, and during the drive period, a selection voltage is applied to the scanning lines in turn and voltages to be written to the pixel circuits are applied to the data lines in turn, and during the pause period, the selection voltage is applied to one or more scanning lines corresponding to measurement target pixel circuits, and in the measuring step, during the pause period, the outputs from the measurement target pixel circuits are measured.

* * * * *